US009752581B2

(12) United States Patent
Ono et al.

(10) Patent No.: US 9,752,581 B2
(45) Date of Patent: Sep. 5, 2017

(54) OIL SUPPLY APPARATUS

(71) Applicant: AISIN SEIKI KABUSHIKI KAISHA, Kariya-shi (JP)

(72) Inventors: Hisashi Ono, Kariya (JP); Yuichi Kato, Kariya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 367 days.

(21) Appl. No.: 14/355,981

(22) PCT Filed: Oct. 23, 2012

(86) PCT No.: PCT/JP2012/077352
§ 371 (c)(1),
(2) Date: May 2, 2014

(87) PCT Pub. No.: WO2013/069451
PCT Pub. Date: May 16, 2013

(65) Prior Publication Data

US 2014/0255222 A1 Sep. 11, 2014

(30) Foreign Application Priority Data

Nov. 7, 2011 (JP) ..... 2011-243788
Nov. 7, 2011 (JP) ..... 2011-243789

(51) Int. Cl.
*F04C 23/02* (2006.01)
*F01M 1/16* (2006.01)
(Continued)

(52) U.S. Cl.
CPC ..... *F04C 23/02* (2013.01); *F01M 1/16* (2013.01); *F01L 2001/34423* (2013.01); *F01M 2001/0246* (2013.01)

(58) Field of Classification Search
CPC ..... F01L 2001/34423; F01M 1/16; F01M 2001/0246; F02B 37/24; F04C 2/086;
(Continued)

(56) References Cited

U.S. PATENT DOCUMENTS 6,374,603 B1 * 4/2002 Morita ..... F01M 1/02 60/421
7,753,016 B2 * 7/2010 Ikoma ..... F02D 13/0215 123/90.15
(Continued)

FOREIGN PATENT DOCUMENTS

JP 48-052004 A 7/1973
JP 61-126004 U 8/1986
(Continued)

OTHER PUBLICATIONS

English Translation of WO 2010013625 (Kazaoka) obtained on May 5, 2016.*
(Continued)

*Primary Examiner* — Dominick L Plakkoottam
*Assistant Examiner* — Connor Tremarche
(74) *Attorney, Agent, or Firm* — Buchanan Ingersoll & Rooney PC

(57) ABSTRACT

An oil supply apparatus supplies oil from an oil pump driven by an engine preferentially to a valve timing control unit. In the oil supply apparatus, a first discharge opening and a second discharge opening having an opening area larger than that of the first discharge opening are formed such that a pressurized region of the oil pump is divided into the two discharge openings. The oil from the first discharge opening is fed to a controlling oil passage through a first discharge port and then supplied to the valve timing controller from the controlling oil passage. The oil from the second discharge opening is fed to a lubricating oil passage through the second
(Continued)

discharge port and then supplied to a main gallery from the lubricating oil passage.

8 Claims, 12 Drawing Sheets

(51) Int. Cl.
*F01L 1/344* (2006.01)
*F01M 1/02* (2006.01)

(58) Field of Classification Search
CPC ..... F04C 23/02; F04C 29/02; F04C 15/008; F04C 15/0092
USPC ..... 417/302
See application file for complete search history.

(56) References Cited

U.S. PATENT DOCUMENTS

| | | | | |
|---|---|---|---|---|
| 2005/0098385 | A1 | 5/2005 | Ono et al. | |
| 2006/0171818 | A1* | 8/2006 | Kato | F01M 1/16 417/302 |
| 2009/0311115 | A1 | 12/2009 | Ono et al. | |
| 2011/0014078 | A1 | 1/2011 | Ono et al. | |
| 2011/0085921 | A1* | 4/2011 | Kato | F01L 1/3442 417/213 |
| 2011/0232594 | A1* | 9/2011 | Miyachi | F01M 1/16 123/90.15 |

FOREIGN PATENT DOCUMENTS

| | | | | |
|---|---|---|---|---|
| JP | 6-212932 | A | 8/1994 | |
| JP | 2002-303111 | A | 10/2002 | |
| JP | 2004-116430 | A | 4/2004 | |
| JP | 2005-140022 | A | 6/2005 | |
| JP | 2005-195029 | A | 7/2005 | |
| JP | 2009-299573 | A | 12/2009 | |
| JP | WO 2010013625 | A1 * | 2/2010 | F04C 2/086 |
| JP | WO 2010110243 | A1 * | 9/2010 | F02B 37/24 |
| JP | 2012-132356 | A | 7/2012 | |

OTHER PUBLICATIONS

English Translation of WO 2010110243 (Kozuka) obtained on May 6, 2016.*

International Search Report (PCT/ISA/210) mailed on Dec. 25, 2012, by the Japanese Patent Office as the International Searching Authority for International Application No. PCT/JP2012/077352.

Written Opinion (PCT/ISA/237) mailed on Dec. 25, 2012, by the Japanese Patent Office as the International Searching Authority for International Application No. PCT/JP2012/077352.

Notification Concerning Transmittal of International Preliminary Report on Patentability (Chapter I of the Patent Cooperation)(Form PCT/IB/326 & Form PCT/IB/373) and the Written Opinion of the International Searching Authority (Translation)(Form PCT/ISA/237) issued on May 22, 2014, in the corresponding International Application No. PCT/JP2012/077352. (8 pages).

* cited by examiner

OIL SUPPLY APPARATUS

TECHNICAL FIELD

The present invention relates to an oil supply apparatus, and particularly relates to an improvement of an oil supply apparatus that supplies oil from an oil pump driven by an engine to a predetermined unit such as a valve timing control unit that controls at least one of the intake timing and the exhaust timing of the engine and another predetermined unit such as a main gallery that lubricates the engine.

BACKGROUND ART

PTL 1 discloses a configuration similar to an oil supply apparatus that is configured as described above, where a priority flow valve (variable pressure control valve) to which the oil is supplied from an oil discharging passage of an oil pump is provided, and a valve timing control unit (phase control unit in this document) is connected to one of two output ports of the priority flow valve, and an engine lubrication apparatus is connected to the other output port. In PTL 1, the priority flow valve includes a valve body biased by a spring, and is configured so that when the pressure of the oil supplied from the oil pump increases, supply of the oil to the valve timing control unit is started first, and afterward, when the oil pressure increases further (when it reaches a predetermined value), supply of the oil to the engine lubrication apparatus is started.

In PTL 1, a bypass oil passage that branches off from the oil discharging passage through which the working oil from the oil pump is supplied to the priority flow valve is connected to the engine lubrication apparatus, and an orifice is provided in the bypass oil passage, whereby the oil can be supplied to the engine lubrication apparatus via the orifice.

PTL 2 discloses a configuration including a mechanical oil pump that sucks the oil in an oil pan and discharges the sucked oil, and an electric oil pump that sucks the oil from an outlet port of the mechanical oil pump and discharges the sucked oil. In PTL 2, an oil passage system through which the oil from the outlet port of the mechanical oil pump is supplied to a main gallery (lubrication unit for various parts of the engine in this document) is formed, and also an oil passage system through which the oil discharged from the electric oil pump is supplied to a valve timing control unit (variable valve timing apparatus in this document) and, when the pressure of the oil discharged from the electric oil pump increases, the oil is supplied to an oil jet apparatus is disclosed.

CITATION LIST

Patent Literature

PTL 1: JP 2009-299573A
PTL 2: JP 2004-116430A

SUMMARY OF INVENTION

Technical Problem

Considering an oil passage system through which the oil from an oil pump driven by an engine is supplied to a valve timing control unit and a main gallery, it is necessary that the oil be reliably supplied to the main gallery and the valve timing control unit. Therefore, with respect to an oil passage system in which the passage for the oil discharged from the oil pump is simply bifurcated, there are cases where a pressure difference on the load side may cause a lack of balance between the amounts of oil supplied to the two routes. Thus, an improvement is desired.

Moreover, even though the oil pressure of the oil to be supplied to the main gallery may be low, the working oil to be supplied to the valve timing control unit needs to have a predetermined oil pressure even when the engine rotates at low speeds.

In this respect, a configuration in which a priority flow valve (variable pressure control valve) is used as in PTL 1 makes it possible to supply the oil whose oil pressure has been increased to the valve timing control unit. However, the amount of oil fed to the bypass oil passage will decrease at the point in time when the supply of the oil to the valve timing control unit is started. Thus, there is room for improvement.

Furthermore, although the configuration disclosed in PTL 2 makes it possible to supply the oil with the electric pump even in a state in which the engine rotates at low speeds, the necessity for the electric pump other than the oil pump driven by the engine results in an increase in the cost. Thus, there is room for improvement.

It is an object of the invention to reasonably configure an oil supply apparatus that supplies oil from an oil pump driven by an engine preferentially to a predetermined unit.

Solution to Problem

A feature of the invention is that an oil supply apparatus includes an oil pump including a pump rotor driven by an engine and a pump housing accommodating the pump rotor, wherein a suction port through which oil is fed to a negative pressure region that is put into a negative pressure state by the pump rotor being rotated is formed in the pump housing, a pressurized region that is put into a pressurized state by the pump rotor being rotated is divided into at least a first discharge opening and a second discharge opening, and a first discharge port and a second discharge port through which the oil is discharged from the first discharge opening and the second discharge opening, respectively, are formed in the pump housing, and the oil supply apparatus further includes a first oil passage through which the oil from the first discharge port is supplied to a first predetermined unit, and a second oil passage through which the oil from the second discharge port is supplied to a second predetermined unit.

With this configuration, the oil in the pressurized region of the oil pump is supplied to the first oil passage from the first oil port connected to the first discharge opening, and also supplied to the second oil passage from the second port connected to the second discharge opening. That is to say, the oil is separated into two routes within the pump housing before being discharged. Thus, even if there is a pressure difference between the first oil passage and the second oil passage, this pressure difference does not affect the other oil passage, and the oil can be supplied to the first predetermined unit connected to the first oil passage and the second predetermined unit connected to the second discharge opening at a fixed ratio. Moreover, with this configuration, when compared with a configuration in which the pressure of the entire oil discharged from the oil pump is increased with a pressure increasing system such as a valve or an orifice, whereby the oil at the increased oil pressure is supplied to the first predetermined unit, and an excess of the oil in the pressure increasing system is supplied to the second predetermined unit, the pressure of only the oil to be supplied to the first predetermined unit is increased. Thus, the engine load can be reduced.

Accordingly, an oil supply apparatus that supplies oil from an oil pump driven by an engine preferentially to a first predetermined unit and also is capable of reducing the engine load is configured.

According to the invention, a regulating mechanism that regulates pump capacity by operation of a regulating member disposed in a position surrounding the pump rotor may further be provided.

With this configuration, regulation of the amounts of oil discharged from the first discharge port and the second discharge port is realized by regulating the pump capacity with the regulating mechanism.

According to the invention, it is also possible that a bypass oil passage that brings the first oil passage and the second oil passage into communication with each other is formed, a pressure regulating valve is provided in the bypass oil passage, and the pressure regulating valve suppresses flow of the oil in the bypass oil passage until an oil pressure in the first oil passage reaches a first set value, and increases the flow of the oil in the bypass oil passage when the oil pressure in the first oil passage exceeds the first set value.

With this configuration, when the rotational speed of the engine is low, even in a state in which the amount of oil supplied to the first oil passage is small, the pressure regulating valve increases the oil pressure to the first set value, whereby the oil at the increased oil pressure can be supplied to the valve timing control unit. Moreover, when the rotational speed of the engine has increased, increasing the amount of oil supplied to the first oil passage, the pressure regulating valve opens, whereby an excess of the oil can be supplied to the main gallery. That is to say, since the pressure of only the oil in the first oil passage is increased with the regulating valve, the engine load is reduced as compared with that of a configuration in which the pressure of the entire oil discharged from the oil pump is increased.

According to the invention, it is also possible that the oil from the first oil passage is supplied to at least one of a valve timing control unit that controls at least one of intake timing and exhaust timing of the engine, a piston jet from which the oil is supplied to a cylinder of the engine in such a manner that the oil is sprayed on the cylinder, and a bearing portion of a turbocharger of the engine to which the oil is supplied.

Since the piston jet supplies the oil to the cylinder of the engine in such a manner that it sprays the oil on the cylinder, a predetermined oil pressure is required. Also, with respect to the bearing portion of the turbocharger, since the oil is supplied to a member rotating at a high speed, a predetermined oil pressure is required. To meet these requirements, according to the invention, the oil whose oil pressure has been increased to the first set pressure with the pressure regulating valve can be supplied to at least one of the valve timing control unit, the piston jet, and the bearing portion of the turbocharger.

According to the invention, it is also possible that after the oil pressure in the first oil passage reaches a value that is higher than the first set value, the pressure regulating valve suppresses the flow of the oil in the bypass oil passage until the oil pressure in the first oil passage reaches a second set value that is higher than the first set value, and increases the flow of the oil in the bypass oil passage when the oil pressure in the first oil passage exceeds the second set value.

With this configuration, the oil pressure in the first oil passage can be increased to the second set value in response to an increase in the rotational speed of the engine. Thus, the oil can be supplied to a hydraulic device or a lubrication system that requires a high oil pressure.

According to the invention, it is also possible that the pump rotor of the oil pump is configured as an internal gear type in which an inner rotor having a plurality of external teeth and a ring-shaped outer rotor having a plurality of internal teeth meshing with the external teeth are accommodated in the pump housing, and the first discharge opening and the second discharge opening are formed at positions separated from each other with respect to a circumferential direction of the outer rotor in the pressurized region.

With this configuration, the oil that is pressurized between the external teeth of the inner rotor and the internal teeth of the outer rotor can be distributed and fed to the first discharge opening and the second discharge opening, which are located at positions separated from each other with respect to the circumferential direction of the outer rotor.

According to the invention, it is also possible that the pump rotor of the oil pump is configured as an internal gear type in which an inner rotor having a plurality of external teeth and a ring-shaped outer rotor having a plurality of internal teeth meshing with the external teeth are accommodated in the pump housing, the first discharge opening and the second discharge opening are formed at positions separated from each other with respect to a circumferential direction of the outer rotor in the pressurized region, and the regulating mechanism includes the regulating member that causes a rotation axis of the outer rotor to revolve around a rotation axis of the inner rotor.

With this configuration, when the regulating mechanism causes the outer rotor to revolve around the axis of the inner rotor, the depth of meshing between the plurality of external teeth and the plurality of internal teeth in each of the pressurized region and the negative pressure region changes, whereby the amounts of oil fed from the pressurized region to the first discharge opening and the second discharge opening are increased/decreased. Moreover, even when the discharge amount is regulated with the regulating mechanism, the oil pressurized between the external teeth of the inner rotor and the internal teeth of the outer rotor can be distributed and fed to the first discharge opening and the second discharge opening, which are located at the separated positions in the circumferential direction of the outer rotor.

According to the invention, it is also possible that the oil pump further includes a biasing mechanism that exerts a biasing force in a direction in which the pump capacity is increased on the regulating member, and an oil pressure exerting space in which an oil pressure in a direction in which the pump capacity is decreased is exerted on the regulating member from the pressurized region.

With this configuration, when the rotational speed of the engine increases from a low state, the oil pressure exerted on the regulating member from the pressurized region via an internal oil passage increases, operating the regulating member in the direction in which the pump capacity is decreased, against the biasing force of the biasing mechanism. By this operation, when the rotational speed of the engine is low, the pump capacity is large, enabling a required amount of oil to be supplied, and when the rotational speed of the engine increases, the pump capacity decreases, suppressing excessive supply of the oil.

According to the invention, it is also possible that the oil pump includes a solenoid valve that controls the oil pressure from the pressurized region and exerts the controlled oil pressure on the regulating member as an operational force for regulating the pump capacity.

With this configuration, since the oil pressure from the pressurized region is exerted on the regulating member by operating the solenoid valve, whereby the pump capacity is regulated, a desired pump capacity can be set by operating the solenoid valve.

DESCRIPTION OF EMBODIMENTS

Hereinafter, embodiments of the invention will be described based on the drawings.

First Embodiment

[Basic Configuration]

Figure 1:
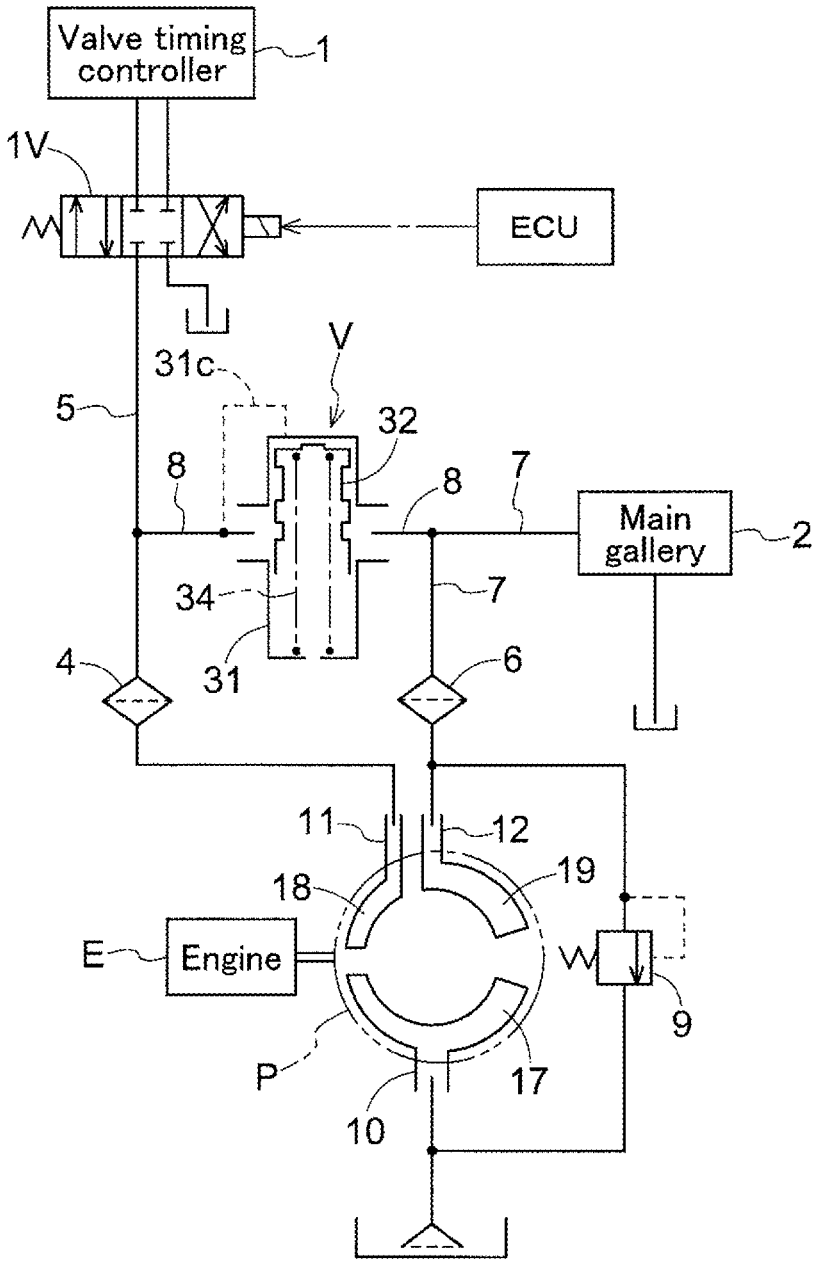
FIG. 1 is a hydraulic circuit diagram showing the configuration of an oil supply apparatus according to a first embodiment.

An oil supply apparatus that supplies oil from an oil pump P driven by an engine E to a valve timing controller 1 (an example of a first predetermined unit and an example of a valve timing control unit) and a main gallery 2 is configured as shown in FIG. 1. In this oil supply apparatus, the valve timing controller 1 is configured to control at least one of the intake timing and the exhaust timing of the engine E, and the main gallery 2 (an example of a second predetermined unit) is constituted by an oil passage system that supplies the oil to various parts of the engine E to lubricate those parts.

The oil pump P includes a single suction port 10 and two discharge ports, that is, a first discharge port 11 and a second discharge port 12, and is configured to suck the oil in an oil pan of the engine E into the suction port 10 and feed the sucked oil to the first discharge port 11 and the second discharge port 12. The configuration of the oil pump P will be described later.

The oil from the first discharge port 11 is fed to a controlling oil passage 5 serving as a first oil passage via a main oil filter 4 and then supplied, from the controlling oil passage 5, to a control valve 1V of the valve timing controller 1. The oil from the second discharge port 12 is fed to a lubricating oil passage 7 serving as a second oil passage via a sub oil filter 6 and then supplied, from the lubricating oil passage 7, to the main gallery 2. A bypass oil passage 8 that connects the controlling oil passage 5 and the lubricating oil passage 7 to each other is further provided, and a pressure regulating valve V is provided in the bypass oil passage 8.

In addition, a relief valve 9 that opens when the oil pressure in the second discharge port 12 has increased to a set pressure is formed.

Although the configuration of the valve timing controller 1 is not shown in the drawing, the valve timing controller 1 is provided at an end portion of a cam shaft (not shown) in order to control the opening/closing timing of at least one of the intake valve and the exhaust valve of the engine E, and, with the oil being supplied and discharged by the control valve 1V, the cam shaft is displaced in either an advance direction or a retard direction with respect to a rotational drive system to which the driving force of the engine E is transmitted, whereby changing of the opening/closing timing is realized. The control valve 1V is operated by a control signal from a timing controller ECU. The control valve 1V is configured to be operable to three positions, that is, an advance control position for displacing the cam shaft in the advance direction, a retard position for displacing the cam shaft in the retard direction, and a neutral position.

Although a single valve timing controller 1 is shown in the drawing, a configuration may also be adopted in which both the opening/closing timing of the intake valve and the opening/closing timing of the exhaust valve are controlled. In the case where such a configuration is adopted, two valve timing controllers 1 and two control valves 1V will be provided, and the oil will be supplied to the control valves 1V respectively corresponding to two oil passages into which the controlling oil passage 5 will be branched.

Figure 2:
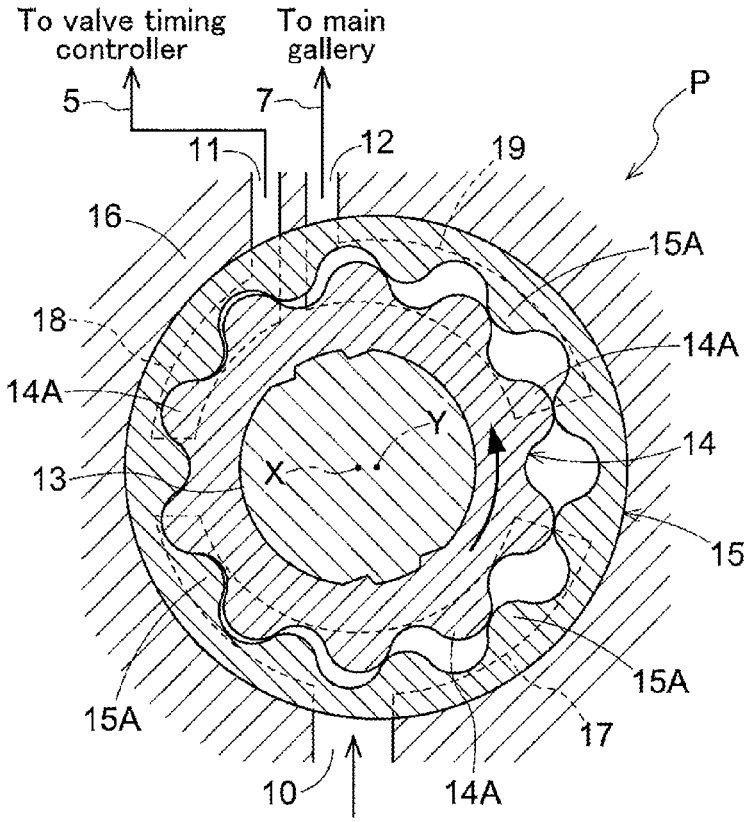
FIG. 2 is a cross-sectional view of an oil pump according to the first embodiment.

[Oil Pump] As shown in FIG. 2, the oil pump P is configured as an internal gear type including an inner rotor 14 (an example of a pump rotor) that is rotated about a driving axis X in a direction indicated by an arrow in the drawing by the driving force of a drive shaft 13 and has a plurality of external teeth 14A, a ring-shaped outer rotor 15 that has a plurality of internal teeth 15A meshing with the external teeth 14A of the inner rotor 14 and is rotatable about a driven axis Y that is eccentric to the driving axis X, and a pump housing 16 that accommodates the above rotors.

Although this oil pump P has a configuration in which the inner rotor 14 is rotated by the drive shaft 13 that is driven by the engine E, a configuration may also be adopted in which the outer rotor 15 is rotated by the driving force of the engine E.

The oil pump P is of a type called an internal gear pump. The external teeth 14A of the inner rotor 14 are shaped to have a tooth surface shape conforming to a mathematical curve. The internal teeth 15A are formed at an inner circumference of the outer rotor 15, the number of the internal teeth 15A being one more than the number of the external teeth 14A of the inner rotor 14.

In this oil pump P, an arc-shaped negative pressure region and an arc-shaped pressurized region that are put into a negative pressure state and a pressurized state, respectively, by the outer rotor 15 rotating with rotation of the inner rotor 14 are formed. A single suction opening 17 is formed in a portion of the pump housing 16 located at a position corresponding to the negative pressure region, and the suction opening 17 and the suction port 10 are in communication with each other via an internal oil passage.

In a portion of the pump housing 16 located at a position corresponding to the pressurized region, a first discharge opening 18 and a second discharge opening 19 are formed at positions separated from each other such that the pressurized region is divided into these two discharge openings. The first discharge opening 18 and the first discharge port 11 are in communication with each other via an internal oil passage, and the second discharge opening 19 and the second discharge port 12 are in communication with each other via an internal oil passage.

The first discharge opening 18 and the second discharge opening 19 are formed side-by-side in a region extending in a circumferential direction of the outer rotor 15. The opening area of the second discharge opening 19 is set to be larger than the opening area of the first discharge opening 18. The reason for this is that while the valve timing controller 1 is operated with a fixed amount of oil independently of the rotational speed of the engine E, the amount of oil necessary for the main gallery 2 increases with an increase in the rotational speed of the engine E. Thus, the opening areas of the first discharge opening 18 and the second discharge opening 19 are set as described above.

With the above configuration, when the drive shaft 13 is rotated, the oil from the suction port 10 is fed to the suction opening 17 and then to the first discharge opening 18 and the second discharge opening 19 such that the oil is distributed to the two discharge openings. The oil from the first discharge opening 18 is discharged from the first discharge port 11, and the oil from the second discharge opening 19 is discharged from the second discharge port 12.

It should be noted that the oil pump P may also have a configuration in which three or more discharge opening are formed in a positional relationship in which the discharge openings are separated from one another, and three or more discharge ports to which the oil from the respective discharge openings is supplied are provided. In the case where such a configuration is adopted, a divided opening of those divided openings whose opening area is set to be small will be connected to the first discharge port 11, and a divided opening whose opening area is set to be large will be connected to the second discharge port 12.

Figure 3:
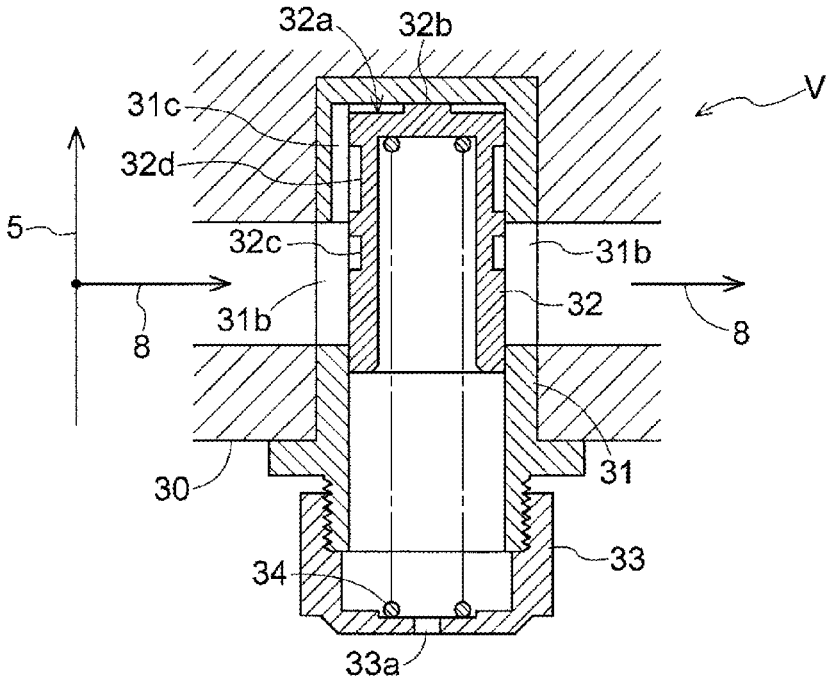
FIG. 3 is a cross-sectional view of a pressure regulating valve according to the first embodiment.

[Pressure Regulating Valve] As shown in FIG. 3, the pressure regulating valve V includes a valve main body 31 that has a passage space through which the oil from the bypass oil passage 8 flows, a valve body 32 that is slidable with respect to the valve main body 31 to change the passage cross-sectional area of the passage space, thereby regulating the amount of oil flowing to the oil passage space, and a cap body 33 that blocks an opening end of the valve main body 31. The valve main body 31 includes a compression coil spring 34 as a biasing mechanism that exerts a biasing force in a direction in which the passage cross-sectional area on the valve body 32 is reduced.

The bypass oil passage 8 having a circular cross-sectional shape is formed in a housing 30. The valve main body 31 is provided so as to be inserted in the middle of the bypass oil passage 8. The valve body 32 is provided in a state in which it is slidably fitted in a cylindrical internal space of the valve main body 31. The oil flows through the bypass oil passage 8 from the left side to the right side in FIG. 3.

In the valve main body 31, the aforementioned cylindrical internal space is formed, and also a pair of through holes 31*b* having circular cross-sectional shapes are formed, the through holes 31*b* being oriented such that they are orthogonal to the sliding direction of the valve body 32. The pair of through holes 31*b* are arranged in respective positions at which they connect the bypass oil passage 8 and the passage space to each other. An oil pressure exerting oil passage 31*c* for exerting the oil pressure from the through hole 31*b* on a pressure receiving surface 32*a* of the valve body 32 to slide the valve body 32 in an opening direction is formed inside the valve main body 31.

The cap body 33 is configured to be coupled to the valve main body 31 by a screw portion. A drain hole 33*a* is formed in a bottom wall of the cap body 33.

A member that has the aforementioned pressure receiving surface 32*a* at its protruding end and opens at the opposite end portion is used as the valve body 32. A protruding portion 32*b* is formed in the center of the pressure receiving surface 32*a*, and a ring-shaped first auxiliary passage 32*c* and a ring-shaped second auxiliary passage 32*d* are formed in an outer circumference of the valve body 32. Also, an accommodation space for the spring 34 is formed inside the valve body 32.

The passage cross-sectional areas of the first auxiliary passage 32*c* and the second auxiliary passage 32*d* are set to smaller values as compared with the passage cross-sectional area of the through holes 31*b* of the valve main body 31, and the passage cross-sectional area of the second auxiliary passage 32*d* is set to be larger than the passage cross-sectional area of the first auxiliary passage 32*c*. A positional relationship of these auxiliary passages is set so that the first auxiliary passage 32*c* allows flow of the oil when the biasing force of the spring 34 keeps the valve body 32 in a closing position as shown in FIGS. 3 and 4A, and the second auxiliary passage 32*d* allows flow of the oil when the valve body 32 has moved because of an increase in the rotational speed (the number of revolutions per unit time) of the engine E (see FIG. 4C).

Figure 4A:
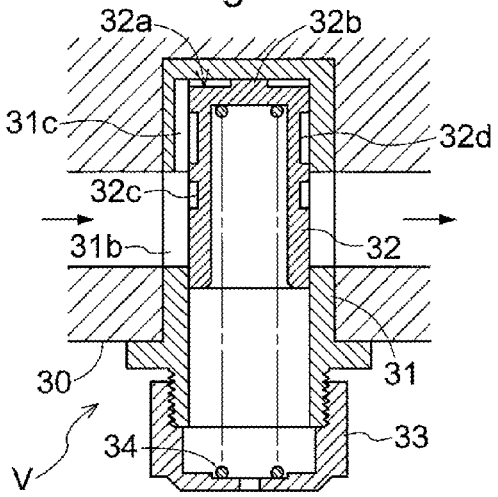
FIG. 4A is a diagram for successively showing the operation of the pressure regulating valve according to the first embodiment.
Figure 4B:
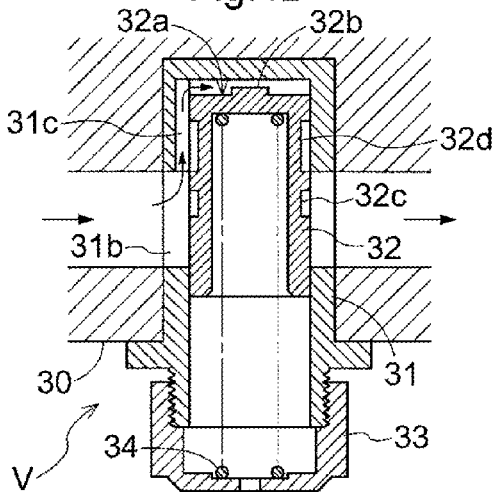
FIG. 4B is a diagram for successively showing the operation of the pressure regulating valve according to the first embodiment.

[Form of Oil Supply] FIGS. 4A to 4E show changes in the operating position of the valve body 32 of the pressure regulating valve V in accordance with changes in the rotational speed (the number of revolutions per unit time) of the engine E. FIG. 5 is a graph showing changes in the oil pressure in the controlling oil passage 5 with respect to the rotational speed of the engine E. In the pressure regulating valve V, in a state in which the engine E is stopped, the biasing force of the spring 34 keeps the protruding portion 32*b* of the valve body 32 in contact with an inner surface of the valve main body 31, and this contact position is an operation starting end for the valve body 32 (FIGS. 3 and 4A). At the operation starting end, a gap is formed between the pressure receiving surface 32*a* of the valve body 32 and an inner wall of the valve main body 31 (inner wall located in an upper portion of the valve main body 31 in FIG. 3), so that the oil pressure in the bypass oil passage 8 can be exerted on the pressure receiving surface 32*a* through the oil pressure exerting oil passage 31*c*. It should be noted that since the oil pressure in the controlling oil passage 5 increases in direct proportion to increases in the amount of oil, the graph in FIG. 5 can also be explained with the rotational speed of the engine E being considered as the amount of oil.

When the engine E is started, the oil is discharged from the first discharge port 11 and the second discharge port 12 of the oil pump P. Since the opening area of the second discharge opening 19 is set to be larger than the opening area of the first discharge opening 18 as described above, the amount of oil discharged from the second discharge port 12 is larger than the amount of oil discharged from the first discharge port 11, where the ratio between the oil amounts is a fixed value.

When operated to the advance control position or the retard position, the control valve 1V supplies/discharges the oil to/from the valve timing controller 1. However, the amount of oil supplied/discharged is relatively small. In addition, in the neutral position, the control valve 1V cuts off the flow of the oil. Accordingly, even in a state in which the rotational speed of the engine E is low, the pressure regulating valve V will increase the oil pressure in the controlling oil passage 5, and thus the oil at a required oil pressure can be supplied to the valve timing controller 1.

When the rotational speed of the engine E increases after the start of the engine E, whereby the amount of oil discharged from the oil pump P increases, the oil pressure exerted on the pressure receiving surface 32*a* of the valve body 32 through the oil pressure exerting oil passage 31*c* increases. Thus, the valve body 32 moves toward the valve body opening side (lower side in FIGS. 3 and 4A to 4E) against the biasing force of the spring 34. Accordingly, the oil initially flows to the first auxiliary passage 32*c*, and subsequently, the state changes to a state in which the oil also flows to the second auxiliary passage 32*d* (FIGS. 4A to 4C).

That is to say, during a period when the rotational speed of the engine E is relatively low, the amount of oil flowing to the controlling oil passage 5 is small, and the oil flows to the first auxiliary passage 32*c*, the oil pressure linearly increases from the origin "0" as the starting point, where the linear line conforms to the set characteristics (0 to R1). Subsequently, when the rotational speed of the engine E increases, the amount of oil flowing to the controlling oil passage 5 also increases, and the situation changes to the situation where the oil also flows to the second auxiliary passage 32*d*, the valve body 32 moves with an increase in the rotational speed of the engine E, and with this movement, the amount of oil flowing to the second auxiliary passage 32*d* also increases. Thus, the oil pressure increases with a smaller gradient than that of the set characteristics (R1 to R2).

Figure 4C:
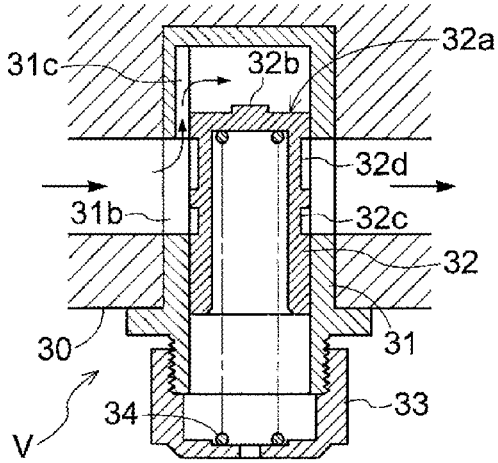
FIG. 4C is a diagram for successively showing the operation of the pressure regulating valve according to the first embodiment.
Figure 4D:
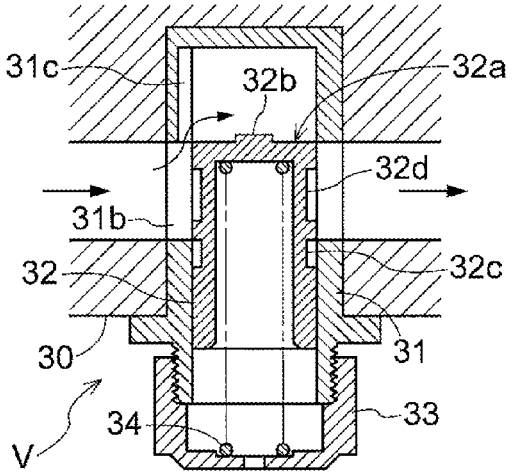
FIG. 4D is a diagram for successively showing the operation of the pressure regulating valve according to the first embodiment.
Figure 4E:
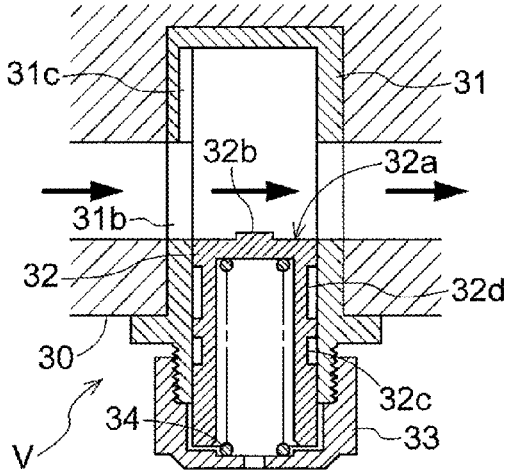
FIG. 4E is a diagram for successively showing the operation of the pressure regulating valve according to the first embodiment.
Figure 5:
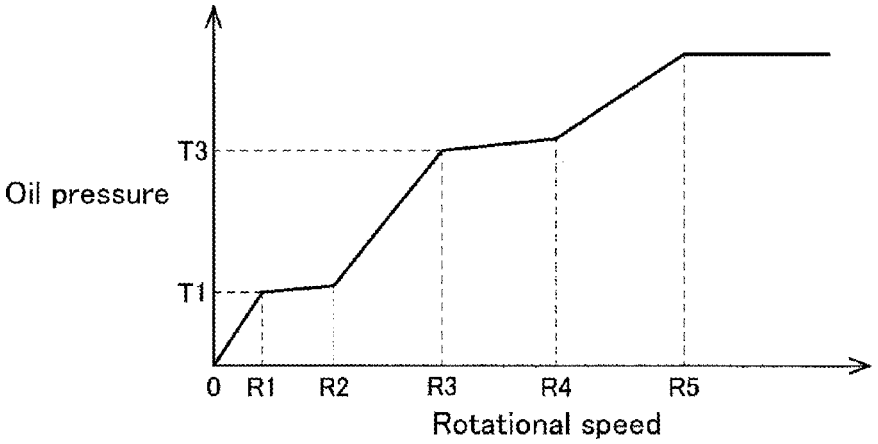
FIG. 5 is a graph showing pressure increase characteristics of the pressure regulating valve according to the first embodiment.

After the rotational speed of the engine E has increased, the amount of oil flowing to the controlling oil passage 5 has increased, and the valve body 32 has been operated and thus reached the position in FIG. 4C, the passage cross-sectional areas of the first auxiliary passage 32*c* and the second auxiliary passage 32*d* do not increase any more. Thus, the oil pressure increases with a gradient similar to that of the set characteristics (R2 to R3).

Then, when the rotational speed of the engine E has increased further, the amount of oil flowing to the controlling oil passage 5 has also increased further, and the pressure receiving surface 32*a* of the valve body 32 has moved to the position at which the through holes 31*b* of the valve main body 31 start to open (the bypass oil passage 8 start to open) (FIG. 4D), the bypass oil passage 8 will be opened from this point onward. Thus, the oil pressure increases with a smaller gradient than that of the set characteristics (R3 to R4).

When the valve body 32 has moved and thereby opened the bypass oil passage 8 as described above, and the valve body 32 has reached an operating end (FIG. 4E), the oil pressure increases with a gradient similar to that of the set characteristics (R4 to R5). When the rotational speed of the engine E increases further in this state, the relief valve 9 opens, thereby suppressing the increase in the oil pressure.

In this oil supply apparatus, the oil pressure at a point in time when the rotational speed of the engine E reaches R1 is used as a reference value T1 (an example of a first set value) to be supplied to the valve timing controller 1, and even when the rotational speed of the engine E is relatively low, the pressure regulating valve V operates to increase the oil pressure in the controlling oil passage 5 to the reference value T1. It should be noted that when the rotational speed of the engine E has reached R3, it becomes possible to increase the oil pressure to an increased pressure value T3 (an example of a second set value).

Effects of First Embodiment

As described above, the oil pump P is configured to discharge the oil from the first discharge port 11 and the second discharge port 12 at a fixed ratio. Thus, a fixed amount of oil is supplied from the controlling oil passage 5, which is the first oil passage, to the valve timing controller 1, and a fixed amount of oil is supplied from the lubricating oil passage 7, which is the second oil passage, to the main gallery 2. Moreover, even when the rotational speed of the engine E is low, the pressure regulating valve V increases the oil pressure to the reference value T1 so that the oil at a required oil pressure can be supplied to the valve timing controller 1, and when the rotational speed of the engine E has increased, an excess of the oil from the controlling oil passage 5 is fed to the lubricating oil passage 7 through the bypass oil passage 8, making it possible to lubricate the engine E without wasting the oil. In particular, in this oil supply apparatus, since the pressure of only the oil in the controlling oil passage 5 is increased with the pressure regulating valve V, the load on the engine E can be reduced as compared with that of a configuration in which the pressure of the entire oil discharged from the oil pump P is increased.

In particular, since the pressure increase characteristics of the pressure regulating valve V are set as shown in FIG. 5, after the pressure regulating valve V gently increases the oil pressure in the region where the rotational speed of the engine E is R1 to R2 after the oil pressure has reached the reference value T1, and also gently increases the oil pressure in the region where the rotational speed of the engine E is R3 to R4 after the oil pressure has reached the increased pressure value T3. Thus, the load on the engine E can be reduced further, and the energy loss is reduced.

Second Embodiment

Figure 6:
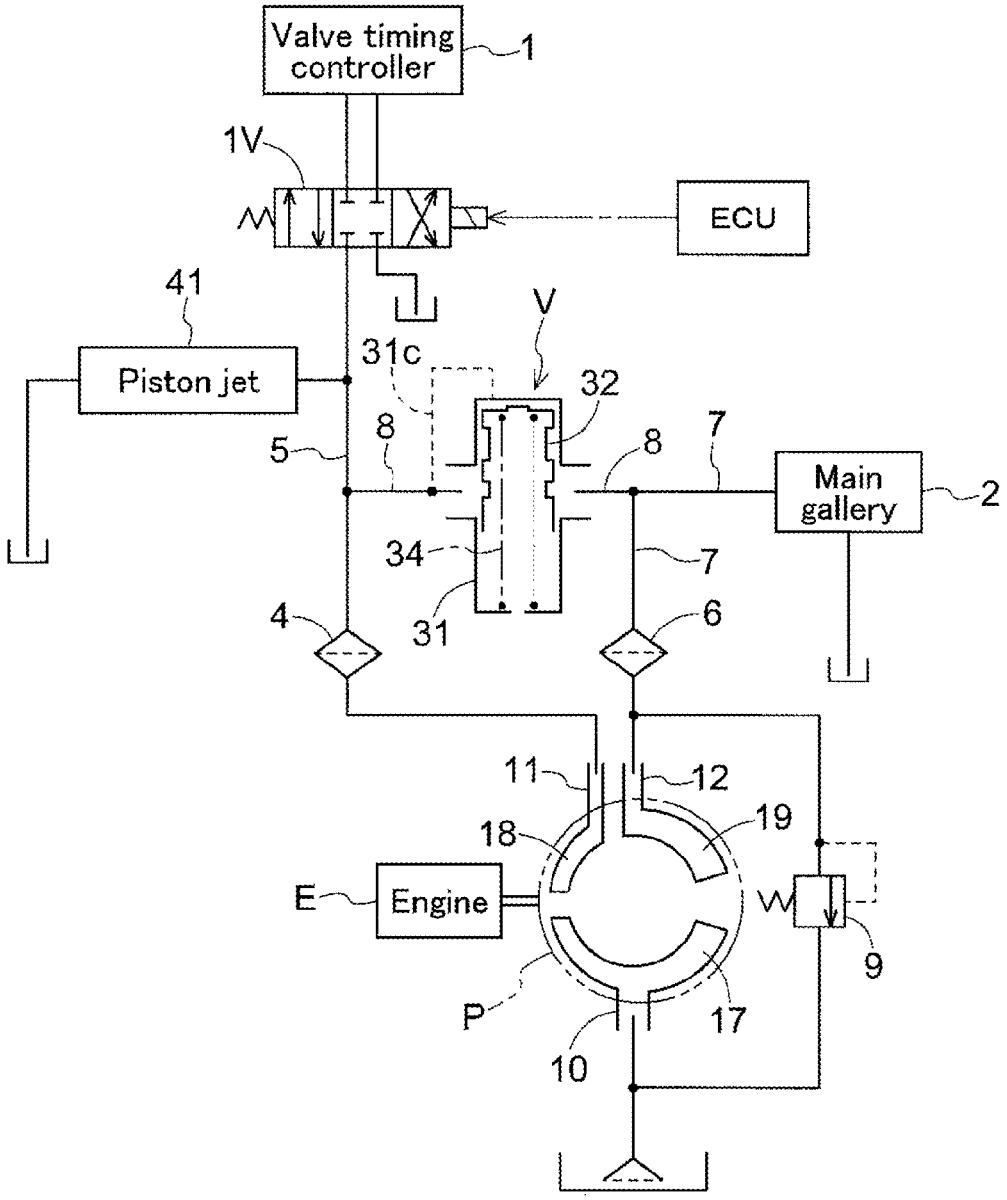
FIG. 6 is a hydraulic circuit diagram showing the configuration of an oil supply apparatus according to a second embodiment.

The second embodiment is the same as the first embodiment except that a configuration for supplying the oil from the controlling oil passage 5 of the first embodiment to a piston jet 41 (an example of a first predetermined unit) is added as shown in FIG. 6.

The piston jet 41 is configured to supply the oil to a piston of the engine E in such a manner that it splays the oil on the piston. Therefore, an oil pressure higher than the reference value T1 described in the first embodiment is required.

In the second embodiment, the increased pressure value T3 described in the first embodiment is set as the oil pressure required by the piston jet 41. By this setting of the increased pressure value T3, the oil at a required oil pressure can be supplied also to the piston jet 41.

Effects of Second Embodiment

In the oil supply apparatus according to the second embodiment, as in the case of the first embodiment, even when the oil pressure in one of the controlling oil passage 5 and the lubricating oil passage 7 decreases, an undesirable situation in which the oil pressure in the other passage decreases does not occur. Furthermore, even when the rotational speed of the engine E is low, the pressure regulating valve V increases the oil pressure to the reference value T1 so that the oil at a required oil pressure can be supplied to the valve timing controller 1. Thus, when the rotational speed of the engine E has increased, an excess of the oil from the controlling oil passage 5 is fed to the lubricating oil passage 7 through the bypass oil passage 8, making it possible to lubricate the engine E without wasting the oil.

In particular, since the pressure regulating valve V increases the oil pressure to the increased pressure value T3, the piston jet 41 can favorably perform lubrication and cooling by spraying the oil on the piston of the engine E. Moreover, since the pressure increase characteristics of the pressure regulating valve V are set as shown in FIG. 5, the load on the engine E can be reduced.

Third Embodiment

Figure 7:
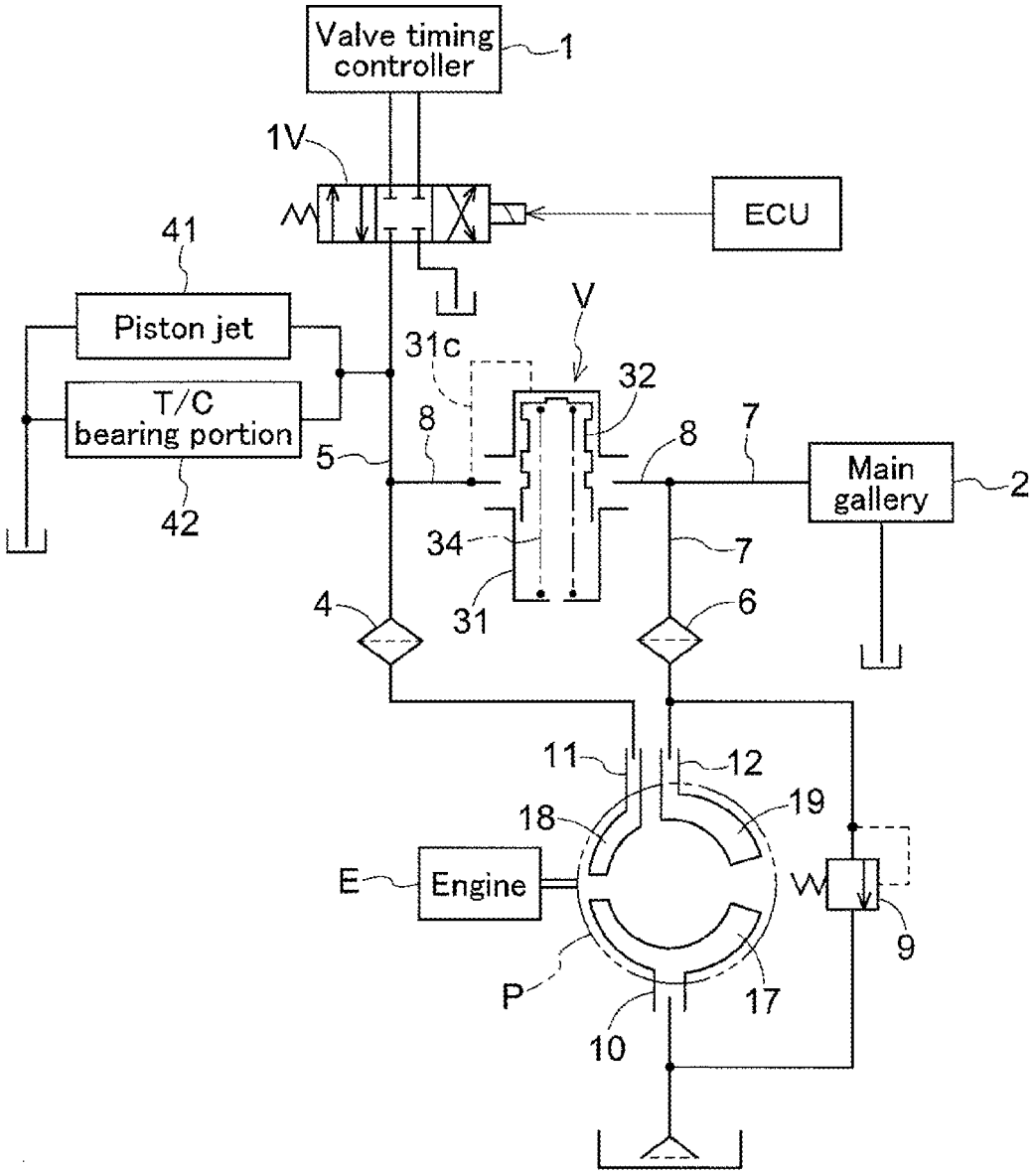
FIG. 7 is a hydraulic circuit diagram showing the configuration of an oil supply apparatus according to a third embodiment.

The third embodiment is the same as the first embodiment except that a configuration for supplying the oil from the controlling oil passage 5 of the first embodiment to a piston jet 41 (an example of the first predetermined unit) and a T/C bearing portion 42 (an example of the first predetermined unit) for supplying the oil to a bearing portion of a turbocharger is added as shown in FIG. 7. The piston jet 41 has the same configuration as that described in the second embodiment.

The T/C bearing portion 42 pressurizes and supplies the oil to the bearing portion of the turbocharger, thereby lubricating and cooling the bearing portion. Thus, an oil pressure higher than the reference value T1 is required as in the case of the piston jet 41 described in the second embodiment.

In the third embodiment, the increased pressure value T3 described in the first embodiment is set as the oil pressure that is required by the piston jet 41 and the T/C bearing portion 42. By this setting of the increased pressure value T3, the oil at a required oil pressure can be supplied to the piston jet 41 and the T/C bearing portion 42.

Effects of Third Embodiment

In the oil supply apparatus according to the third embodiment, as in the case of the first embodiment, even when the oil pressure of one of the controlling oil passage 5 and the lubricating oil passage 7 decreases, an undesirable situation where the other oil pressure decreases does not occur. Furthermore, even when the rotational speed of the engine E is low, the pressure regulating valve V increases the oil pressure to the reference value T1 so that the oil at a required oil pressure can be supplied to the valve timing controller 1. When the rotational speed of the engine E increases, an excess of the oil from the controlling oil passage 5 is fed to the lubricating oil passage 7 through the bypass oil passage 8, making it possible to lubricate the engine E without wasting the oil.

In particular, since the pressure regulating valve V increases the oil pressure to the increased pressure value T3, the piston jet 41 can favorably perform lubrication and cooling by spraying the oil on the piston of the engine E, and the T/C bearing portion 42 can favorably perform lubrication and cooling by supplying the oil at a high oil pressure to the bearing portion of the turbocharger. Moreover, since the pressure increase characteristics of the pressure regulating valve V are set as shown in FIG. 5, the load on the engine E can be reduced.

Other Embodiments

In addition to the above-described embodiments, the invention may also be configured as follows.

(a) An oil passage system may be formed so that the oil in the controlling oil passage 5 is supplied to the valve timing controller 1 and the T/C bearing portion 42. With this configuration, reasonable oil supply is realized by setting the reference value T1 to be achieved by the pressure regulating valve V to a value that is required by the T/C bearing portion 42.

(b) The oil in the controlling oil passage 5 may also be supplied to a device that requires the oil, in addition to the valve timing controller 1. The target to which the oil is to be supplied in this manner is not limited to that having a direct relation to the engine E, but may be an actuator.

(c) The pressure regulating valve V that is necessary for the first embodiment can be any valve that achieves the reference value T1. Thus, there is no need to generate the two different levels of oil pressure, that is, the reference value T1 and the increased pressure value T3. For example, a valve, such as a relief valve or an unload valve, that is configured to not generate an oil pressure exceeding the reference value T1 may also be used. With this configuration, the load on the engine E can be reduced even further.

(d) The oil pump P may be configured as a vane pump type including an inner rotor 14 driven by the engine E, a pump housing 16 having a space in which the inner rotor 14 is accommodated, and vanes retractably attached to the inner rotor 14.

Even when the oil pump P is configured by a vane pump as described above, discharge openings are formed by dividing the pressurized region within the pump into at least two portions, that is, the first discharge opening 18 having a small opening area and the second discharge opening 19 having a larger opening area. Then, the oil passage is configured so that the oil from the first discharge opening 18 is fed to the first discharge port 11, and the oil from the second discharge opening 19 is supplied to the second discharge port 12.

(e) Whether the oil pump P is of an internal gear type or of a vane pump type, the order in which the first discharge opening 18 and the second discharge opening 19 are arranged in a direction along the rotating direction of the inner rotor 14 is not limited to the order described in the first embodiment, but may be the inverse order.

Fourth Embodiment

[Basic Configuration]

Figure 8:
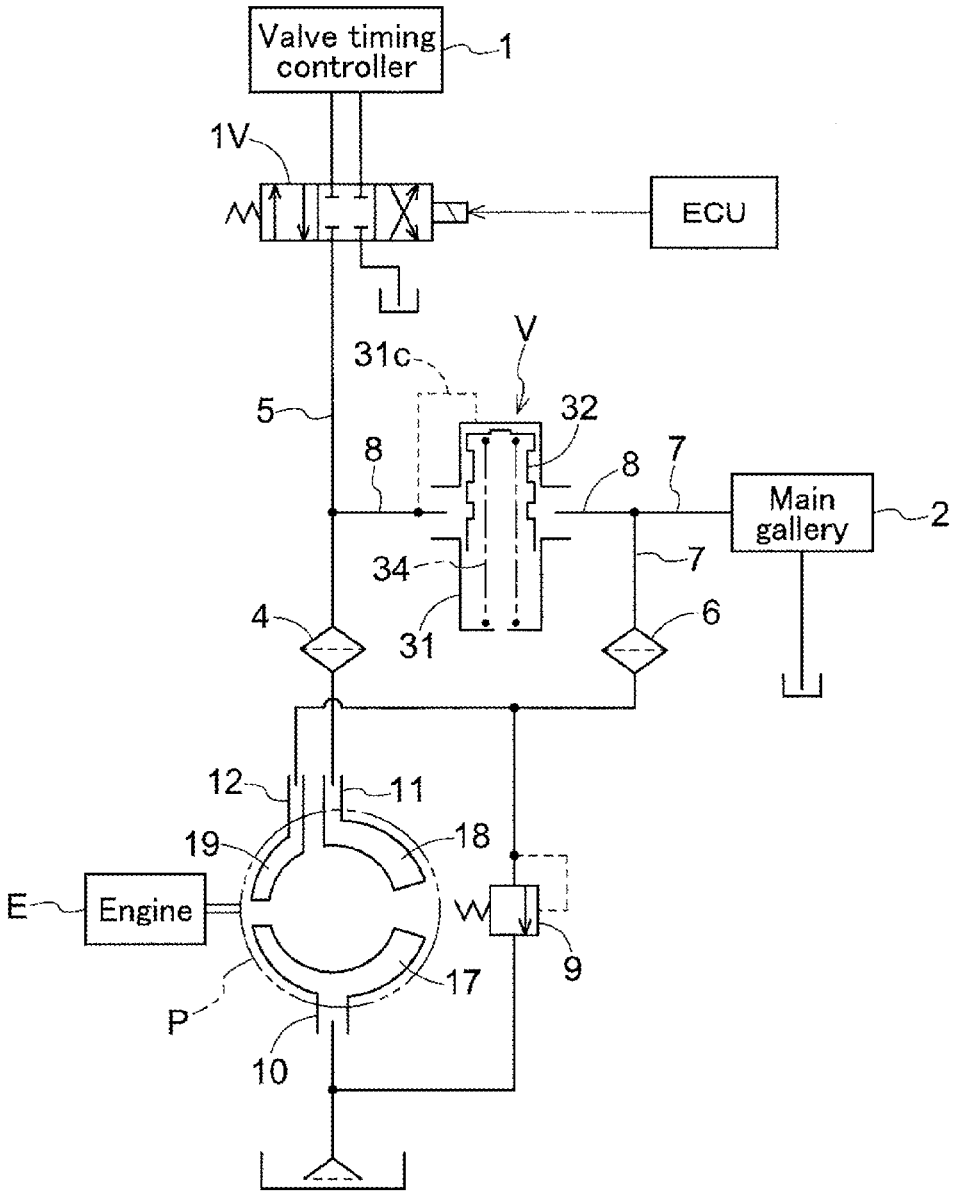
FIG. 8 is a hydraulic circuit diagram showing the configuration of an oil supply apparatus according to a fourth embodiment.

As shown in FIG. 8, an oil supply apparatus that supplies oil from an oil pump P driven by an engine E to a valve timing controller 1 (an example of the first predetermined unit and an example of the valve timing control unit) and a main gallery 2 is configured. In this oil supply apparatus, the valve timing controller 1 is configured to control at least one of the intake timing and the exhaust timing of the engine E, and the main gallery 2 (an example of the second predetermined unit) is configured by an oil passage system for supplying the oil to various parts of the engine E to lubricate those parts.

The oil pump P includes a single suction port 10 and two discharge ports, that is, a first discharge port 11 and a second discharge port 12, and is configured to suck the oil in an oil pan of the engine E into the suction port 10 and feed the oil to the first discharge port 11 and the second discharge port 12. The configuration of the oil pump P will be described later.

The oil from the first discharge port 11 is fed to an controlling oil passage 5 serving as the first oil passage via a main oil filter 4 and then supplied, from the controlling oil passage 5, to a control valve 1V of the valve timing controller 1. On the other hand, the oil from the second discharge port 12 is fed to a lubricating oil passage 7 serving as the second oil passage via a sub oil filter 6 and then supplied, from the lubricating oil passage 7, to the main gallery 2. Furthermore, a bypass oil passage 8 connecting the controlling oil passage 5 and the lubricating oil passage 7 to each other is provided, and a pressure regulating valve V is provided in this bypass oil passage 8.

A regulating mechanism A, which will be described later, regulates the discharge amount of oil. In addition to this, a relief valve 9 that opens when the oil pressure at the second discharge port 12 has increased to a set pressure may further be formed. The relief valve 9 is not needed as long as the discharge amount of oil is regulated by the regulating mechanism A. However, the relief valve 9 may also be provided as a backup mechanism that is available in case the regulating mechanism A does not work.

Although the configuration of the valve timing controller 1 is not shown in the drawing, the valve timing controller 1 is provided at an end portion of a cam shaft (not shown) in order to control the opening/closing timing of at least one of the intake valve and the exhaust valve of the engine E, and supplies/discharges the oil with the control valve 1V to displace the cam shaft in either the advance direction or the retard direction with respect to a rotational drive system to which the driving force of the engine E is transmitted, thereby changing the opening/closing timing. The control valve 1V is operated by a control signal from a timing controller ECU. The control valve 1V is configured to be operable to three positions, that is, an advance control position for displacing the cam shaft in the advance direction, a retard position for displacing the cam shaft in the retard direction, and a neutral position.

Although a single valve timing controller 1 is shown in the drawing, a configuration in which both the opening/closing timing of the intake valve and the opening/closing timing of the exhaust valve are controlled may also be adopted. In the case where this configuration is adopted, two valve timing controllers 1 and two control valves 1V will be provided, and the oil will be supplied to the control valves 1V respectively corresponding to two oil passages into which the controlling oil passage 5 will be branched.

Figure 9A:
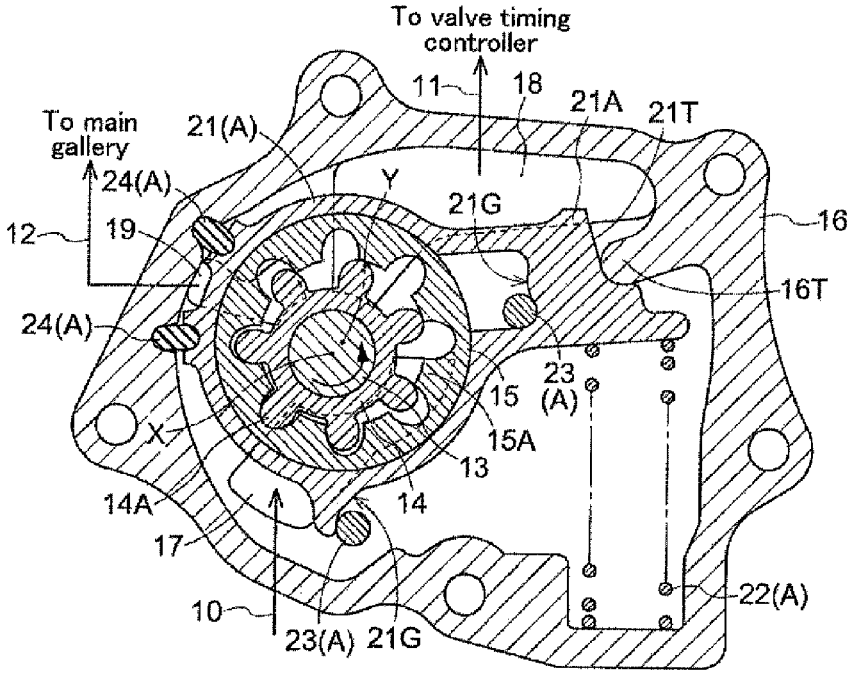
FIG. 9A is a cross-sectional view of an oil pump according to the fourth embodiment.
Figure 9B:
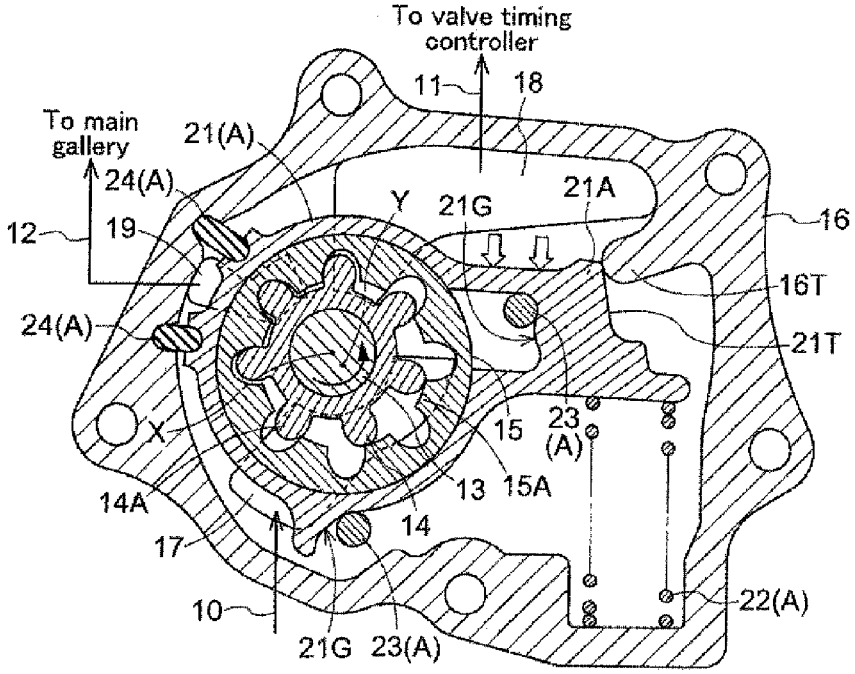
FIG. 9B is a cross-sectional view of the oil pump according to the fourth embodiment.

[Oil Pump] As shown in FIGS. 9A and 9B, the oil pump P includes an inner rotor 14 (an example of the pump rotor) that is rotated about a driving axis X in a direction indicated by an arrow in the drawings by the driving force of a drive shaft 13 and includes a plurality of external teeth 14A, a ring-shaped outer rotor 15 that includes a plurality of internal teeth 15A meshing with the external teeth 14A of the inner rotor 14 and is rotatable about a driven axis Y that is eccentric to the driven axis Y, the regulating mechanism A that regulates the discharge amounts from the first discharge port 11 and the second discharge port 12 (regulates the pump capacity), and a pump housing 16 accommodating the above components. Thus, the oil pump P is configured as an internal gear type capable of regulating the pump capacity. Although this oil pump P has a configuration in which the inner rotor 14 is rotated by the drive shaft 13 driven by the engine E, a configuration in which the outer rotor 15 is rotated by the driving force of the engine E may also be adopted.

The oil pump P is of a type that is called an internal gear pump. The external teeth 14A of the inner rotor 14 are shaped to have a tooth surface shape conforming to a mathematical curve. The internal teeth 15A are formed at an inner circumference of the outer rotor 15, the number of the internal teeth 15A being one more than the number of the external teeth 14A of the inner rotor 14.

In this oil pump P, an arc-shaped negative pressure region and an arc-shaped pressurized region that are put into a negative pressure state and a pressurized state, respectively, by the outer rotor 15 rotating with rotation of the inner rotor 14 are formed. A single suction opening 17 is formed in a portion of the pump housing 16 located at a position corresponding to the negative pressure region, and the suction opening 17 and the suction port 10 are in communication with each other via an internal oil passage.

Also, in a portion of the pump housing 16 located at a position corresponding to the pressurized region, a first discharge opening 18 and a second discharge opening 19 are formed at positions separated from each other such that the pressurized region is divided into these two discharge openings. The first discharge opening 18 and the first discharge port 11 are in communication with each other via an internal oil passage. The second discharge opening 19 and the second discharge port 12 are in communication with each other via an internal oil passage.

The first discharge opening 18 and the second discharge opening 19 are formed side-by-side in a region extending in the circumferential direction of the outer rotor 15. The opening area of the first discharge opening 18 is set to be larger than the opening area of the second discharge opening 19.

The regulating mechanism A includes a regulating ring 21, serving as a regulating member, to which the outer rotor 15 is internally fitted in a rotatable manner, a regulating spring 22, serving as a biasing mechanism, for exerting a biasing force on the regulating ring 21, a pair of guide pins 23 for setting a displacement direction of the regulating ring 21, and oil seals 24 disposed between the regulating ring 21 and the pump housing 16.

An arm portion 21A protruding outward from the regulating ring 21 (an example of the regulating member) is formed. A sliding contact portion 21T is formed on the protruding side of the arm portion 21A. A guide portion 16T protruding from an inner portion of the pump housing 16 and coming into contact with the sliding contact portion 21T is formed. Moreover, a guide surface 21G is formed in a space created by cutting away a part of the arm portion 21A, and another guide surface 21G is formed at an outer circumference of the regulating ring 21. The aforementioned guide pins 23 are in contact with these guide surfaces 21G.

With the above configuration, when the regulating ring 21 is displaced while being guided by the pair of guide pins 23 and the guide portion 16T, the outer rotor 15 moves in such a manner that the driven axis Y revolves around the driving axis X. This movement changes the meshing relationship between the external teeth 14A of the inner rotor 14 and the internal teeth 15A of the outer rotor 15, and thus regulation of the oil discharge amount is realized.

More specifically, when the regulating ring 21 is oriented as shown in FIG. 9A, the meshing between the external teeth 14A of the inner rotor 14 and the internal teeth 15A of the outer rotor 15 changes largely in the pressurized region (region where the first discharge opening 18 and the second discharge opening 19 are present), and thus the oil discharge amount is maximized (the pump capacity is maximized). On the other hand, when the regulating ring 21 is oriented as shown in FIG. 9B, the meshing between the external teeth 14A of the inner rotor 14 and the internal teeth 15A of the outer rotor 15 changes a little in the pressurized region, and thus the oil discharge amount is minimized (the pump capacity is minimized).

The regulating spring 22 (an example of the biasing mechanism) exerts the biasing force that operates the regulating ring 21 in a direction in which the oil discharge amount is increased (hereinafter referred to as "increasing direction"). In addition, a hydraulic structure that allows the oil pressure from the first discharge opening 18 (doubling as an oil pressure exerting space) to be exerted on the arm portion 21A of the regulating ring 21 is provided inside the pump housing 16. Accordingly, when the oil pressure from the first discharge opening 18 is exerted, the regulating ring 21 is operated in a direction in which the pump capacity is decreased (hereinafter referred to as "decreasing direction") against the biasing force of the regulating ring 21.

With the above configuration, when the engine E is stopped, the regulating ring 21 is in a limit orientation in the increasing direction shown in FIG. 9A, and when the oil pressure in the first discharge opening 18 has increased in accordance with an increase in the rotational speed of the engine E, the regulating ring 21 is operated in the decreasing direction against the biasing force of the regulating spring 22. When the oil pressure has exceeded the set value, the regulating ring 21 reaches a limit orientation in the decreasing direction shown in FIG. 9B.

In this oil pump P, when the drive shaft 13 is rotated by the driving force of the engine E, the oil from the suction port 10 is fed to the suction opening 17, and this oil is fed to the first discharge opening 18 and the second discharge opening 19 such that the oil is distributed to these two discharge openings. Then, the oil from the first discharge opening 18 is discharged from the first discharge port 11, and the oil from the second discharge opening 19 is discharged from the second discharge port 12. Moreover, when the rotational speed of the engine E is relatively low, a minimum required amount of oil is secured by setting a large pump capacity with the regulating mechanism A, and when the rotational speed of the engine E has increased, the amount of oil discharged from the oil pump P is increased by reducing the pump capacity with the regulating mechanism A, although an excessive increase in the amount of oil discharged from the oil pump P is prevented.

In particular, with this oil pump P, when the regulating ring 21 is operated in the decreasing direction by the regulating mechanism A, the rate of decrease in the amount of oil discharged from the first discharge opening 18 is higher than the rate of decrease in the amount of oil discharged from the second discharge opening 19, and so there is a possibility that a sufficient amount of oil cannot be secured. For this reason, the oil from the first discharge opening 18 is fed to the controlling oil passage 5 and supplied to the valve timing controller 1. With this configuration, even when the rotational speed of the engine E has increased, causing the regulating mechanism A to operate the regulating ring 21 in the decreasing direction, a required amount of oil from the oil pump P is secured so that the valve timing controller 1 can be reliably controlled.

It should be noted that the oil pump P may also have a configuration in which three or more discharge openings are formed in a positional relationship in which the discharge openings are separated from one another, and three or more discharge ports to which the oil from the respective discharge openings is supplied are provided. In the case where such a configuration is adopted, the discharge opening that enables a certain amount of oil to be secured even when the regulating ring 21 is operated in the decreasing direction by the regulating mechanism A will be connected to the first discharge port 11.

[Pressure Regulating Valve] The pressure regulating valve V is the same as that of the first embodiment, whose structure and operation thereof are shown in FIGS. 3 and 4A to 4E, and thus a detailed description thereof will not be given here.

Figure 10:
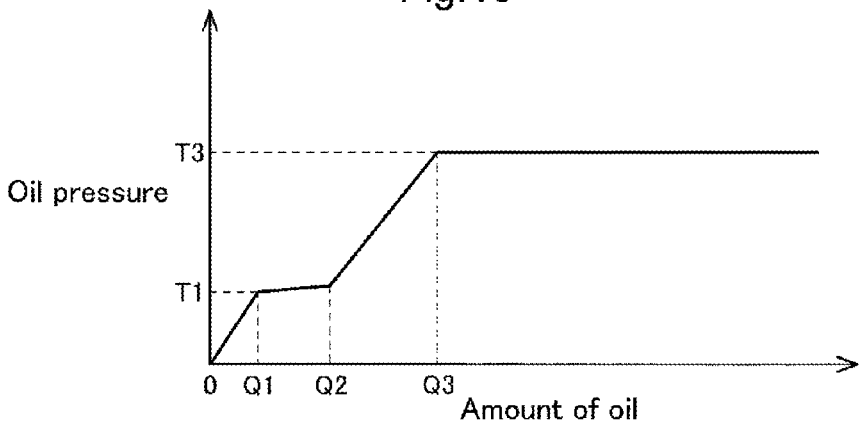
FIG. 10 is a graph showing pressure increase characteristics of a pressure regulating valve according to the fourth embodiment.

[Form of Oil Supply] FIGS. 4A to 4E show changes in the operating position of the valve body 32 of the pressure regulating valve V in accordance with increases in the oil pressure of the oil supplied from the oil pump P (those increases may be considered as increases in the amount of oil). FIG. 10 is a graph showing changes in the oil pressure in the controlling oil passage 5 with respect to the amount of oil. In the pressure regulating valve V, in a state in which the engine E is stopped, the biasing force of the spring 34 keeps the protruding portion 32*b* of the valve body 32 in contact with the inner surface of the valve main body 31, and this contact position is an operation starting end for the valve body 32 (FIGS. 3 and 4A). At the operation starting end, a gap is formed between the pressure receiving surface 32*a* of the valve body 32 and an inner wall (inner wall located in an upper portion of the valve main body 31 in FIG. 3) of the valve main body 31, whereby the oil pressure in the bypass oil passage 8 can be exerted on the pressure receiving surface 32*a* through the oil pressure exerting oil passage 31*c*.

When the engine E is started, the oil is discharged from the first discharge port 11 and the second discharge port 12 of the oil pump P. The control valve 1V supplies/discharges the oil to/from the valve timing controller 1 when it is operated to the advance control position or the retard position. However, the amount of oil supplied/discharged is relatively small. In addition, in the neutral position, the control valve 1V cuts off the flow of the oil. Accordingly, even in a state in which the rotational speed of the engine E is low, the pressure regulating valve V will increase the oil pressure in the controlling oil passage 5, and thus the oil at a required oil pressure can be supplied to the valve timing controller 1.

After the start of the engine E, when the rotational speed of the engine E increases, increasing the amount of oil discharged from the oil pump P, the oil pressure exerted on the pressure receiving surface 32*a* of the valve body 32 through the oil pressure exerting oil passage 31*c* increases. Thus, the valve body 32 moves toward the valve body opening side (lower side in FIGS. 3 and 4A to 4E) against the biasing force of the spring 34. Accordingly, the oil initially flows to the first auxiliary passage 32*c*, and subsequently, the state changes to a state in which the oil also flows to the second auxiliary passage 32*d* (FIGS. 4A to 4C).

More specifically, in the case where the rotational speed of the engine E is relatively low, the amount of oil flowing to the controlling oil passage 5 is small, and the oil flows to the first auxiliary passage 32*c*, the oil pressure linearly increases from the origin "0" as the starting point, where the linear line conforms to the set characteristics (0 to Q1). Subsequently, when the rotational speed of the engine E has increased, increasing the amount of oil flowing to the controlling oil passage 5, and thus the situation changes to the situation where the oil also flows to the second auxiliary passage 32*d*, the valve body 32 moves with an increase in the rotational speed of the engine E. With this movement, the amount of oil flowing to the second auxiliary passage 32*d* also increases. Thus, the oil pressure increases with a smaller gradient than that of the set characteristics (Q1 to Q2).

When the rotational speed of the engine E has increased further, increasing the amount of oil flowing to the controlling oil passage 5 and operating the valve body 32, the valve body 32 reaches the position in FIG. 4C. After the valve body 32 has reached this position, since the passage cross-sectional areas of the first auxiliary passage 32*c* and the second auxiliary passage 32*d* do not increase any more, the oil pressure increases with a gradient similar to that of the set characteristics (Q2 to Q3).

Then, when the rotational speed of the engine E has increased even further, increasing the amount of oil flowing to the controlling oil passage 5 even further, and thus the pressure receiving surface 32*a* of the valve body 32 has moved to the position at which the through holes 31*b* of the valve main body 31 start to open (position at which the bypass oil passage 8 starts to open) (FIG. 4D), since if the rotational speed of the engine E increases further from this state, the bypass oil passage 8 will open (FIG. 4E), the increase in the oil pressure is suppressed (from Q3 onward).

In this oil supply apparatus, the oil pressure at the point in time when the amount of oil supplied to the controlling oil passage 5 has reached Q1 is used as the reference value T1 (an example of the first set value) to be supplied to the valve timing controller 1, and even when the rotational speed of the engine E is relatively low, the pressure regulating valve V operates to increase the oil pressure in the controlling oil passage 5 to the reference value T1. It should be noted that when the amount of oil supplied to the controlling oil passage 5 has reached Q3, it becomes possible to increase the oil pressure to the increased pressure value T3 (an example of the second set value).

Effects of Fourth Embodiment

As described above, in this oil supply apparatus, the oil from the first discharge port 11 of the oil pump P is supplied to the valve timing controller 1 through the controlling oil passage 5 serving as the first oil passage, and the oil from the second discharge port 12 is supplied to the main gallery 2 through the lubricating oil passage 7 serving as the second oil passage. Furthermore, even when the rotational speed of the engine E is low, the pressure regulating valve V increases the oil pressure to the reference value T1 so that the oil at a required oil pressure can be supplied to the valve timing controller 1. When the rotational speed of the engine E has increased, an excess of the oil from the controlling oil passage 5 is fed to the lubricating oil passage 7 through the bypass oil passage 8, making it possible to lubricate the engine E without wasting the oil.

In particular, since the pressure increase characteristics of the pressure regulating valve V are set as shown in FIG. 10, the pressure regulating valve V gently increases the oil pressure in the region where the amount of oil supplied to the controlling oil passage 5 is Q1 to Q2 after the oil pressure has reached the reference value T1, and also gently increases the oil pressure in the region where the amount of oil supplied to the controlling oil passage 5 is Q3 and onward after the oil pressure has reached the increased pressure value T3. Thus, the load on the engine E can be reduced, and the energy loss can also be reduced.

Fifth Embodiment

Figure 11:
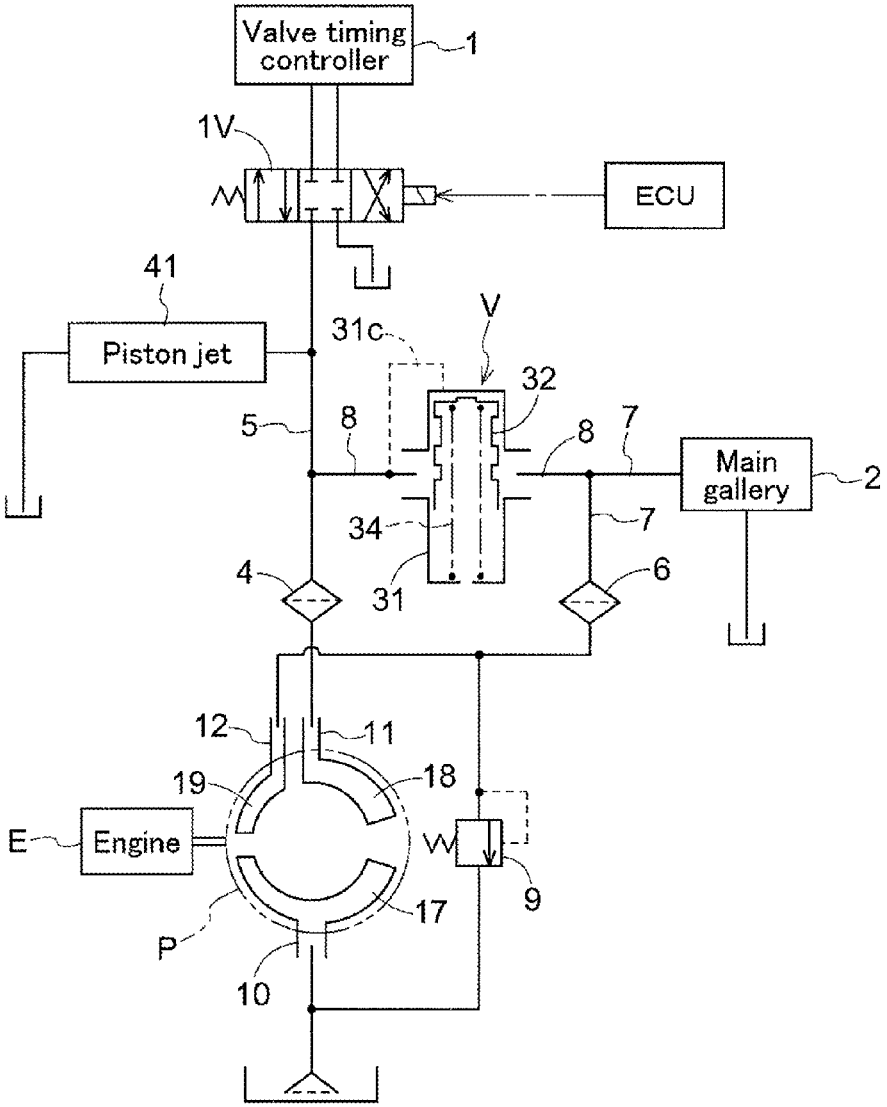
FIG. 11 is a hydraulic circuit diagram showing the configuration of an oil supply apparatus according to a fifth embodiment.

The fifth embodiment is the same as the first embodiment except that a configuration for supplying the oil from the controlling oil passage 5 of the first embodiment to a piston jet 41 (an example of the first predetermined unit) is added as shown in FIG. 11.

The piston jet 41 is configured to supply the oil to the engine E in such a manner that it sprays the oil on the piston of the engine E. Thus, an oil pressure higher than the reference value T1 described in the first embodiment is required.

In the second embodiment, the increased pressure value T3 described in the first embodiment is set as the oil pressure required by the piston jet 41. By this setting of the increased pressure value T3, it is possible to supply the oil at a required oil pressure also to the piston jet 41.

Effects of Fifth Embodiment

In the fifth embodiment, as in the case of the fourth embodiment, a fixed amount of oil is supplied from the controlling oil passage 5 serving as the first oil passage to the valve timing controller 1, and a fixed amount of oil is supplied from the lubricating oil passage 7 serving as the second oil passage to the main gallery 2. In this oil supply apparatus, even when the oil pressure in either the controlling oil passage 5 or the lubricating oil passage 7 is decreased, an undesirable situation in which the oil pressure in the other oil passage decreases does not occur. Furthermore, even when the rotational speed of the engine E is low, the pressure regulating valve V increases the oil pressure to the reference value T1 so that the oil at a required oil pressure can be supplied to the valve timing controller 1. When the rotational speed of the engine E has increased, an excess of the oil from the controlling oil passage 5 is fed to the lubricating oil passage 7 through the bypass oil passage 8, making it possible to lubricate the engine E without wasting the oil.

In particular, since the pressure regulating valve V increases the oil pressure to the increased pressure value T3, the piston jet 41 can favorably perform lubrication and cooling by spraying the oil on the piston of the engine E. Moreover, since the pressure increase characteristics of the pressure regulating valve V are set as shown in FIG. 10, the load on the engine E can be reduced.

Sixth Embodiment

Figure 12:
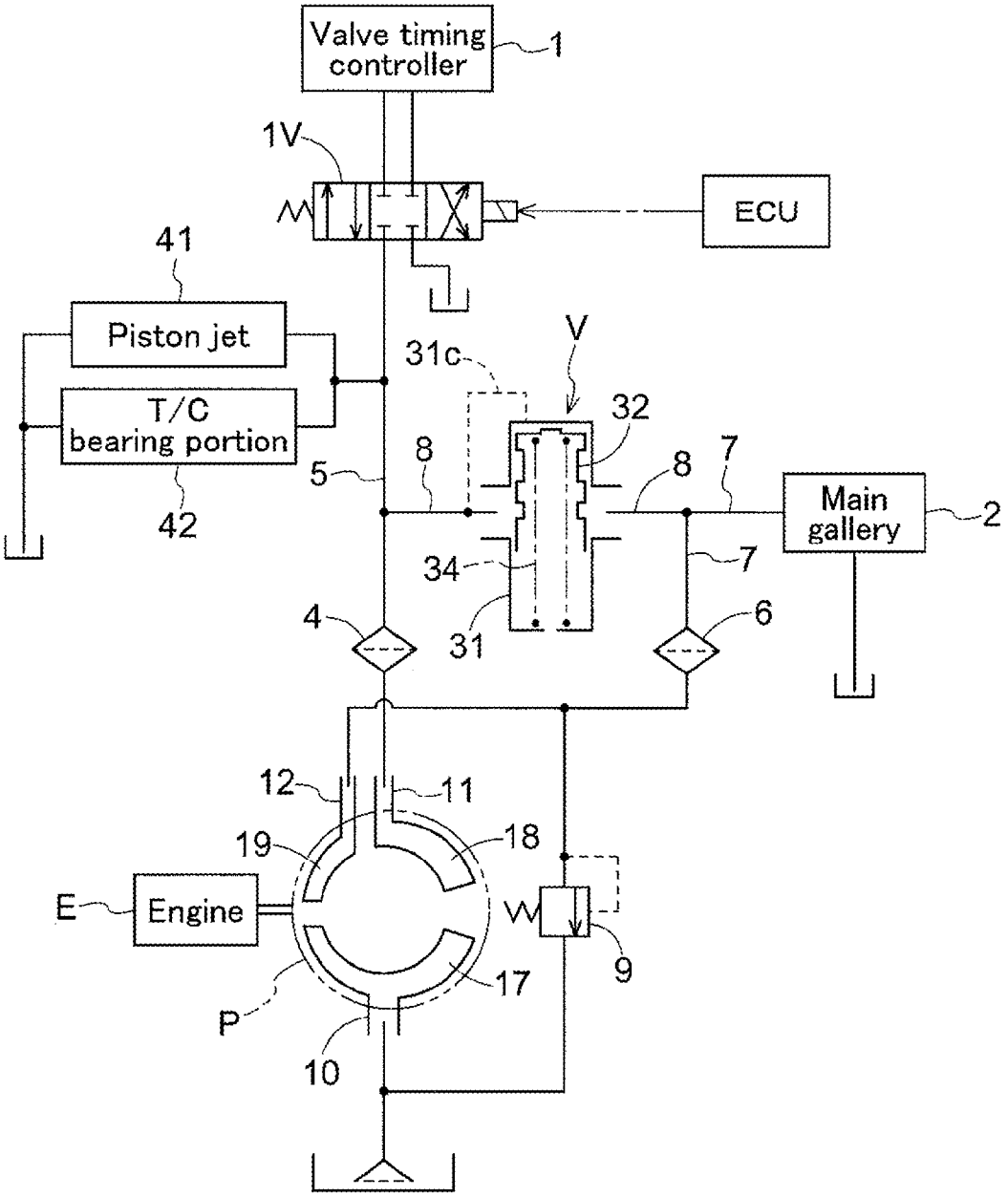
FIG. 12 is a hydraulic circuit diagram showing the configuration of an oil supply apparatus according to a sixth embodiment.

The sixth embodiment is the same as the first embodiment except that a configuration for supplying the oil from the controlling oil passage 5 of the first embodiment to a piston jet 41 (an example of the first predetermined unit) and a T/C bearing portion 42 (an example of the first predetermined unit) for supplying the oil to a bearing portion of a turbocharger is added as shown in FIG. 12. The piston jet 41 has the same configuration as that described in the second embodiment.

The T/C bearing portion 42 pressurizes and supplies the oil to the bearing portion of the turbocharger, thereby lubricating and cooling the bearing portion. Thus, an oil pressure higher than the reference value T1 is required as in the case of the piston jet 41 described in the second embodiment.

In the sixth embodiment, the increased pressure value T3 described in the first embodiment is set as the oil pressure that is required by the piston jet 41 and the T/C bearing portion 42. By this setting of the increased pressure value T3, the oil at a required oil pressure can be supplied to the piston jet 41 and the T/C bearing portion 42.

Effects of Sixth Embodiment

In the sixth embodiment, as in the case of the first embodiment, a fixed amount of oil is supplied from the controlling oil passage 5 serving as the first oil passage to the valve timing controller 1, and a fixed amount of oil is supplied from the lubricating oil passage 7 serving as the second oil passage to the main gallery 2. In this oil supply apparatus, even when the oil pressure in either the controlling oil passage 5 or the lubricating oil passage 7 is decreased, an undesirable situation in which the oil pressure in the other oil passage decreases does not occur. Furthermore, even when the rotational speed of the engine E is low, the pressure regulating valve V increases the oil pressure to the reference value T1 so that the oil at a required oil pressure can be supplied to the valve timing controller 1. When the rotational speed of the engine E has increased, an excess of the oil from the controlling oil passage 5 is fed to the lubricating oil passage 7 through the bypass oil passage 8, making it possible to lubricate the engine E without wasting the oil.

In particular, since the pressure regulating valve V increases the oil pressure to the increased pressure value T3, the piston jet 41 can favorably perform lubrication and cooling by spraying the oil on the piston of the engine E, and the T/C bearing portion 42 can favorably perform lubrication and cooling by supplying the oil at a high oil pressure to the bearing portion of the turbocharger. Moreover, since the pressure increase characteristics of the pressure regulating valve V are set as shown in FIGS. 4A to 4E, the load on the engine E can be reduced.

Other Embodiments

In addition to the above-described embodiments, the invention may also be configured as follows.

Figure 13A:
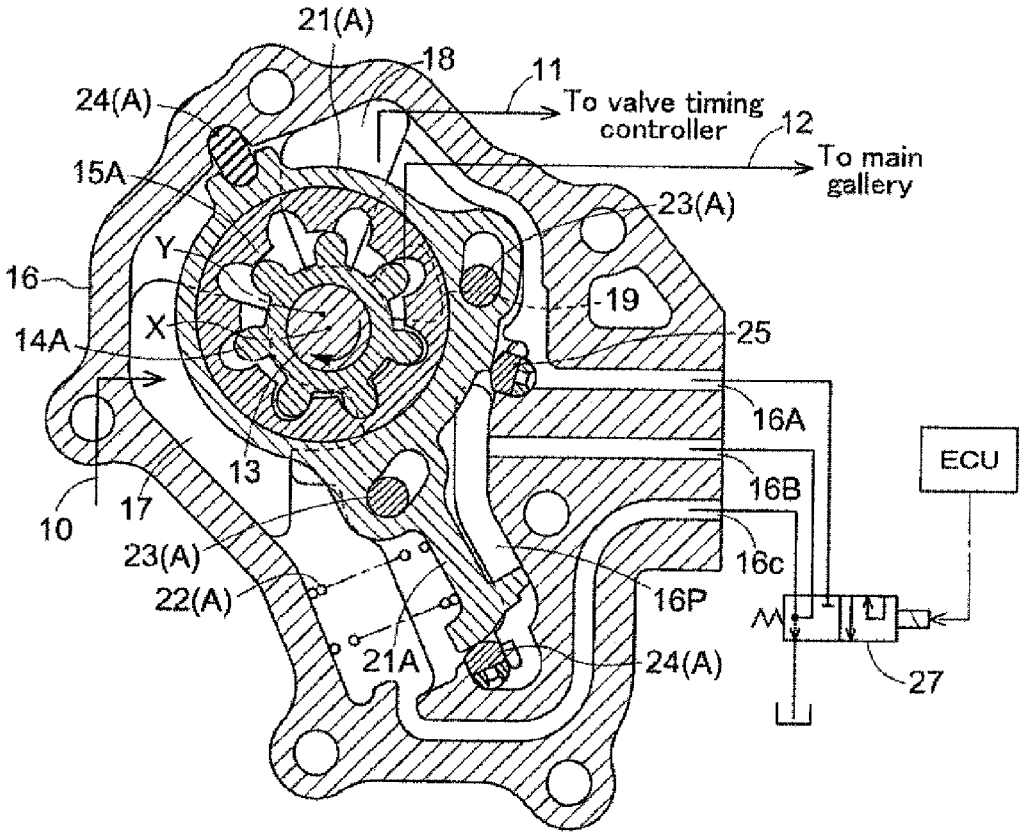
FIG. 13A is an overall view showing the configuration of an oil pump according to another embodiment (a).
Figure 13B:
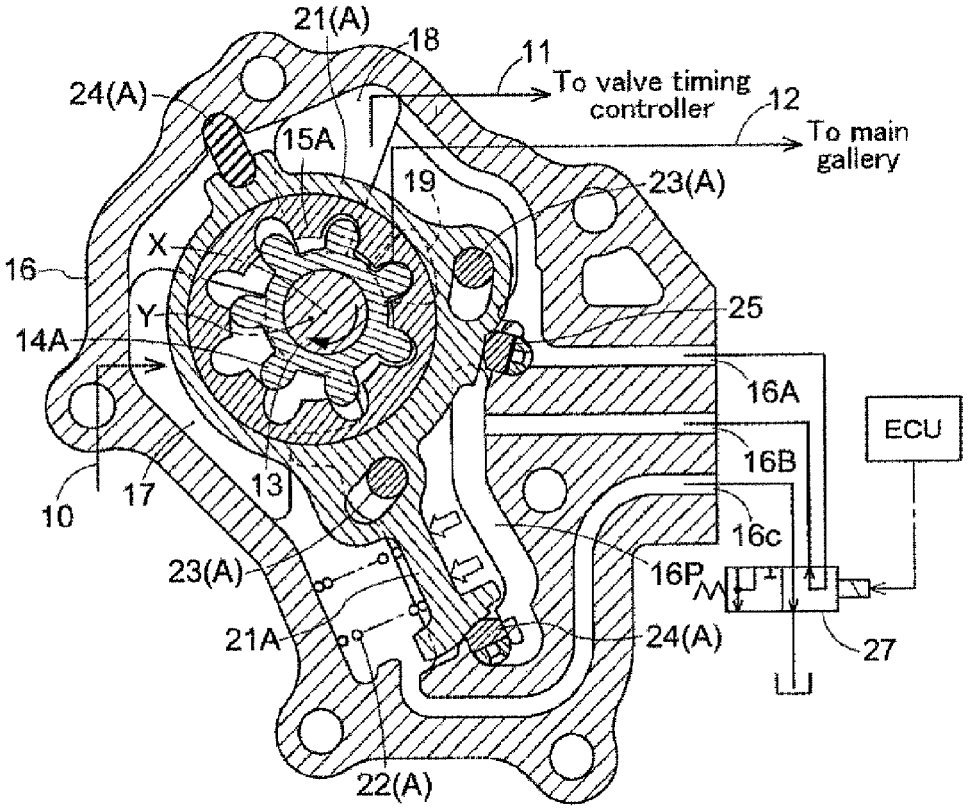
FIG. 13B is an overall view showing the configuration of the oil pump according to the other embodiment (a).

(a) As shown in FIGS. 13A and 13B, the oil pump P may be configured to include an inner rotor 14 that is rotated about a driving axis X by the driving force of a drive shaft 13 and includes a plurality of external teeth 14A, a ring-shaped outer rotor 15 that includes a plurality of internal teeth 15A meshing with the external teeth 14A of the inner rotor 14 and is rotatable about a driven axis Y that is eccentric to the driven axis Y, a regulating mechanism A that regulates the discharge amounts from a first discharge port 11 and a second discharge port 12 (regulates the pump capacity), a pump housing 16 accommodating these components, and a solenoid valve 27 for operating the regulating mechanism A. In this embodiment (a), components having like functions as the functions of those of the fourth embodiment are denoted by like reference numerals or symbols as those in the fourth embodiment.

In a portion of the pump housing 16 located at a position corresponding to the pressurized region, a first discharge opening 18 and a second discharge opening 19 are formed at positions separated from each other such that the pressurized region is divided into these two discharge openings. The first discharge opening 18 and the first discharge port 11 are in communication with each other via an internal oil passage. The second discharge opening 19 and the second discharge port 12 are in communication with each other via an internal oil passage.

In this oil pump P, as compared with the oil pump P of the fourth embodiment, the form of operation of a regulating ring 21 when the regulating mechanism A regulates the pump capacity is the same as that of the fourth embodiment. However, the configuration for setting the orientation of the regulating ring 21, such as the guide pins 23, is different, and the configuration for regulating the pump capacity with the solenoid valve 27 is different. Oil seals 24 are provided in an outer circumferential portion of the regulating ring 21 and a protruding end portion of an arm portion 21A.

In this oil pump P, a pressurized space 16P in which an oil pressure is exerted on the arm portion 21A of the regulating ring 21 against the biasing force from the regulating spring 22 is formed, and a separation seal 26 for separating the pressurized space 16P from the first discharge opening 18 is provided. The solenoid valve 27 is provided outside the pump housing 16. A supply oil passage 16A for supplying the oil from the first discharge opening 18 to the solenoid valve 27, a pressurizing oil passage 16B for supplying the oil from the solenoid valve 27 to the pressurized space 16P, and a draining oil passage 16C and 9 for feeding the oil from the solenoid valve 27 to the suction opening 17 are formed in the pump housing 16.

With the above configuration, in a state in which the oil pressure is prevented from being exerted on the pressurized space 16P by the control of the solenoid valve 27, the biasing force of the regulating spring 22 causes the regulating ring 21 to reach a limit orientation at which the pump capacity is increased, as shown in FIG. 13A, where the pump capacity is maximized. In a state in which the oil pressure is exerted on the pressurized space 16P by the control of the solenoid valve 27, the regulating ring 21 is operated in the direction in which the oil capacity exerted on the pressurized space 16P is decreased, against the biasing force of the regulating spring 22. By this operation, the regulating ring 21 reaches a limit orientation in the decreasing direction as shown in FIG. 13B, where the pump capacity is minimized.

With this oil pump P, the pump capacity can be automatically decreased with an increase in the oil pressure when the oil pressure from the first discharge opening 18 is allowed to be continuously exerted on the pressurized space 16P by the solenoid valve 27. In addition, the oil pressure exerted on the pressurized space 16P can also be regulated by intermittent control of the solenoid valve 27. By setting the oil pressure exerted on the pressurized space 16P as desired, it is possible to set a required pump capacity.

In order to set the pump capacity to a required value, it is effective that a potentiometer detecting the orientation of the regulating ring 21 is provided, whereby control is performed so that the orientation detected by the potentiometer is kept to be a target orientation, or that a pressure sensor detecting the oil pressure in the pressurized space 16P is provided, whereby control is performed so as that the oil pressure detected by the pressure sensor is kept to be a target value. To perform such control, it is practical to change the duty ratio of an intermittent signal for driving the electromagnetic solenoid of the solenoid valve 27.

This embodiment (a) is not limited to the above-described form of control. It is also possible to detect the rotational speed of the engine E with a sensor or detect the oil pressure in the first discharge opening 18 with a sensor and perform control by changing the duty ratio of the intermittent signal for driving the electromagnetic solenoid of the solenoid valve 27 based on the detected value. The pump capacity of the oil pump P can also be set to a desired value by such control.

With the oil pump P having the above configuration, a required amount of oil is discharged independently of the rotational speed of the engine E, whereby control of the valve timing controller 1 is realized.

(b) An oil passage system may be formed so that the oil in the controlling oil passage 5 is supplied to the valve timing controller 1 and the T/C bearing portion 42. With this configuration, reasonable oil supply is realized by setting the reference value T1 to be achieved by the pressure regulating valve V to a value that is required by the T/C bearing portion 42.

(c) A configuration may be adopted in which the oil in the controlling oil passage 5 is supplied to a device that requires the oil, in addition to the valve timing controller 1. The target to which the oil is to be supplied in this manner is not limited to that having direct relation to the engine E, but may be an actuator.

(d) Since the pressure regulating valve V that is necessary in the fourth embodiment can be any valve that achieves the reference value T1, it is not necessary to generate the two different levels of oil pressure, that is, the reference value T1 and the increased pressure value T3. For example, a valve, such as a relief valve or an unload valve, that is configured to not generate an oil pressure exceeding the reference value T1 may be used. With this configuration, the load on the engine E can be reduced even further.

(e) The oil pump P may be configured as a vane pump type that includes an inner rotor 14 driven by the engine E, a pump housing 16 having, for example, a ring-like member in which the inner rotor 14 is accommodated, and vanes retractably attached to the inner rotor 14, and is capable of regulating the oil capacity by regulating the position of the ring-like member. When the oil pump P is configured by a vane pump as described above, the pressurized region in the pump is divided into a plurality of subregions, and a subregion in which a certain oil discharge amount is secured even when the pump capacity is regulated in the decreasing direction is set as the first discharge opening 18, and another subregion is set as the second discharge opening 19.

Even when the vane pump type oil pump P having the above configuration is used, since the first discharge opening 18 and the second discharge opening 19 are formed, separated from each other, a fixed amount of oil is supplied from the controlling oil passage 5 serving as the first oil passage to the valve timing controller 1, and a fixed amount of oil is supplied from the lubricating oil passage 7 serving as the second oil passage to the main gallery 2.

(f) Whether the oil pump P is of an internal gear type or of a vane pump type, the order in which the first discharge opening 18 and the second discharge opening 19 are arranged in a direction along the rotating direction of the inner rotor 14 is not limited to the order described in the first embodiment, but may be the inverse order.

From the foregoing description, the following technical idea will be conceived.

[Additional Remark 1]

An oil supply apparatus including:

an oil pump driven by an engine, the oil pump including an inner rotor having a plurality of external teeth, an outer rotor having a plurality of internal teeth meshing with the external teeth, a suction port into which oil is sucked as a result of the volume of a space partitioned by the external teeth and the internal teeth being increased, and a first discharge port and a second discharge port from which the oil is discharged as a result of the volume of the space partitioned by the external teeth and the internal teeth being decreased;

a first oil passage through which the oil from the first discharge port is supplied to a first predetermined unit; and a second oil passage through which the oil from the second discharge port is supplied to a second predetermined unit that is different from the first predetermined unit.

INDUSTRIAL APPLICABILITY

The invention can be used in all oil supply apparatuses that supply oil from an oil pump driven by an engine to a valve timing control unit and a main gallery.

REFERENCE SIGNS LIST

1 First predetermined unit/valve timing control unit (valve timing controller)
2 Second predetermined unit (main gallery)
5 First oil passage (controlling oil passage)
7 Second oil passage (lubricating oil passage)
8 Bypass oil passage
10 Suction port
11 First discharge port
12 Second discharge port
14 Pump rotor/inner rotor
14A External teeth
15 Outer rotor
15A Internal teeth
16 Pump housing
18 First discharge opening/oil pressure exerting space
19 Second discharge opening
21 Regulating member (regulating ring)
22 Biasing mechanism (regulating spring)
27 Solenoid valve
41 First predetermined unit/piston jet
42 First predetermined unit/bearing portion (T/C bearing portion)
E Engine
P Oil pump
T1 First set value (reference value)
T3 Second set value (increased pressure value)
V Pressure regulating valve

The invention claimed is:

1. An oil supply apparatus comprising:

an oil pump comprising:

a pump rotor driven by an engine; and a pump housing accommodating the pump rotor, wherein a suction port through which oil is fed to a negative pressure region that is put into a negative pressure state by the pump rotor being rotated is formed in the pump housing, and a pressurized region that is put into a pressurized state by the pump rotor being rotated is divided into at least a first discharge opening and a second discharge opening, and a first discharge port and a second discharge port through which the oil is discharged from the first discharge opening and the second discharge opening, respectively, are formed in the pump housing, the oil supply apparatus further comprising:

a first oil passage through which the oil from the first discharge port is supplied to at least one of a valve timing control unit that controls at least one of intake timing and exhaust timing of the engine, a piston jet from which the oil is supplied to a cylinder of the engine in such a manner that the oil is sprayed on the cylinder, and a bearing portion of a turbocharger of the engine to which the oil is supplied; and a second oil passage through which the oil from the second discharge port is supplied to a main gallery, wherein a bypass oil passage that brings the first oil passage and the second oil passage into communication with each other is formed, and a pressure regulating valve is provided in the bypass oil passage, the pressure regulating valve suppresses flow of the oil in the bypass oil passage until an oil pressure in the first oil passage reaches a first set value, and increases the flow of the oil in the bypass oil passage when the oil pressure in the first oil passage exceeds the first set value, after the oil pressure in the first oil passage reaches a value that is higher than the first set value, the pressure regulating valve suppresses the flow of the oil in the bypass oil passage until the oil pressure in the first oil passage reaches a second set value that is higher than the first set value, and increases the flow of the oil in the bypass oil passage when the oil pressure in the first oil passage exceeds the second set value, the pressure regulating valve includes a valve main body that has a through hole communicated with the bypass oil passage, and a valve body positioned in the valve main body and slidable with respect to the valve main body to change a passage cross-sectional area of the through hole, a first auxiliary passage and a second auxiliary passage are formed in an outer surface of the valve body, a passage cross-sectional area of the first auxiliary passage being smaller than the passage cross-sectional area of the through hole, and a passage cross-sectional area of the second auxiliary passage being smaller than the passage cross-sectional area of the through hole and larger than the passage cross-sectional area of the first auxiliary passage, and the valve body slides such that: the oil flows in the first auxiliary passage until the oil pressure in the first oil passage reaches the first set value; the oil flows in the first auxiliary passage and the second auxiliary passage when the oil pressure in the first oil passage exceeds the first set value and until the oil pressure in the first oil passage reaches the second set value; and the oil flows in the through hole when the oil pressure in the first oil passage exceeds the second set value.

2. The oil supply apparatus according to claim 1, further comprising:

a regulating mechanism that regulates pump capacity by operation of a regulating member disposed in a position surrounding the pump rotor.

3. The oil supply apparatus according to claim 1, wherein the pump rotor of the oil pump is configured as an internal gear type in which an inner rotor having a plurality of external teeth and a ring-shaped outer rotor having a plurality of internal teeth meshing with the external teeth are accommodated in the pump housing, and the first discharge opening and the second discharge opening are formed at positions separated from each other with respect to a circumferential direction of the outer rotor in the pressurized region.

4. The oil supply apparatus according to claim 2, wherein the pump rotor of the oil pump is configured as an internal gear type in which an inner rotor having a plurality of external teeth and a ring-shaped outer rotor having a plurality of internal teeth meshing with the external teeth are accommodated in the pump housing, the first discharge opening and the second discharge opening are formed at positions separated from each other with respect to a circumferential direction of the outer rotor in the pressurized region, and the regulating mechanism includes the regulating member that causes a rotation axis of the outer rotor to revolve around a rotation axis of the inner rotor.

5. The oil supply apparatus according to claim 4, wherein the oil pump comprises:

a biasing mechanism that exerts a biasing force in a direction in which the pump capacity is increased on the regulating member, and an oil pressure exerting space in which an oil pressure in a direction in which the pump capacity is decreased is exerted on the regulating member from the pressurized region.

6. The oil supply apparatus according to claim 4, wherein the oil pump comprises a solenoid valve that controls the oil pressure from the pressurized region and exerts the controlled oil pressure on the regulating member as an operational force for regulating the pump capacity.

7. The oil supply apparatus according to claim 1, wherein an opening area of the second discharge opening is larger than an opening area of the first discharge opening.

8. The oil supply apparatus according to claim 1, wherein the valve body includes a pressure receiving surface on which an oil pressure from the through hole is exerted, and an oil pressure exerting oil passage is formed inside the valve main body, the oil pressure exerting oil passage communicated with the pressure receiving surface to slide the valve body in an opening direction.

* * * * *